United States Patent [19]

Hasebe et al.

[11] Patent Number: 5,028,515

[45] Date of Patent: Jul. 2, 1991

[54] METHOD FOR PRODUCING A COLOR PRINT COMPRISING DEVELOPING A SPECIFIC MATERIAL WITHOUT BENZYL ALCOHOL

[75] Inventors: Kazunori Hasebe; Koji Takahashi, both of Minami-Ashigara, Japan

[73] Assignee: Fuji Photo Film Co., Ltd., Minami-Ashigara, Japan

[21] Appl. No.: 596,731

[22] Filed: Oct. 15, 1990

Related U.S. Application Data

[63] Continuation of Ser. No. 85,391, Aug. 14, 1987, abandoned.

[30] Foreign Application Priority Data

Aug. 15, 1986 [JP] Japan ..... 61-191417

[51] Int. Cl.[5] ..... G03C 7/30; G03C 7/32; G03C 7/34; G03C 1/46

[52] U.S. Cl. ..... 430/374; 430/383; 430/464; 430/467; 430/478; 430/505; 430/546; 430/551; 430/552; 430/553; 430/556; 430/557; 430/558; 430/567

[58] Field of Search ..... 430/372, 380, 383, 434, 430/464, 467, 478, 505, 546, 551, 552, 553, 556, 557, 558, 567, 374

[56] References Cited

U.S. PATENT DOCUMENTS

| | | | |
|---|---|---|---|
| 4,026,706 | 5/1977 | Nakamura et al. | 96/74 |
| 4,336,324 | 6/1982 | Koboshi et al. | 430/372 |
| 4,564,591 | 1/1986 | Tanaka et al. | 430/567 |
| 4,590,155 | 5/1986 | Klotzer | 430/567 |
| 4,605,610 | 8/1986 | Klotzer | 430/567 |
| 4,607,002 | 8/1986 | Nakayama et al. | 430/505 |
| 4,622,287 | 11/1986 | Umemoto et al. | 430/505 |
| 4,668,611 | 5/1987 | Nakamura | 430/505 |
| 4,692,399 | 9/1987 | Sasaki et al. | 430/507 |

FOREIGN PATENT DOCUMENTS

| | | |
|---|---|---|
| 161577 | 4/1985 | European Pat. Off. . |
| 163314 | 5/1985 | European Pat. Off. . |
| 182566 | 5/1986 | European Pat. Off. . |
| 158446 | 8/1985 | Japan . |
| 60-222852 | 11/1985 | Japan . |
| 61-22342 | 1/1986 | Japan . |
| 61-167952 | 7/1986 | Japan . |
| 1063669 | 3/1967 | United Kingdom . |

OTHER PUBLICATIONS

"Performance of Porous Cellulose Acetate Membranes for the Reverse . . . ", A. R. Hauck et al., *Environmental Science and Technology,* vol. 3, No. 9, 12/69, 1269–1275.

*Chemical Abstracts,* vol. 105, 1986, p. 375, Abstract No. 196954t, Columbus, Ohio.

*Chemical Abstracts,* vol. 85, 1976, p. 420, Abstract No. 166266w, Columbus, Ohio.

*Chemical Abstracts,* vol. 90, 1979, p. 105, Abstract No. 146322m, Columbus, Ohio.

*Chemical Abstracts,* vol. 89, 1978, p. 307, Abstract No. 80253k, Columbus, Ohio.

*Primary Examiner*—Charles L. Bowers, Jr.
*Assistant Examiner*—Patrick A. Doody
*Attorney, Agent, or Firm*—Burns, Doane, Swecker & Mathis

[57] ABSTRACT

In a color print containing cyan, magenta and yellow colored dyes, the color print where the spectral absorption peak wave lengths of the respective colored dyes lie in the range represented by the following formula:

$$\tfrac{1}{2}(\lambda y+\lambda c) \geqq \lambda m \geqq \tfrac{1}{2}(\lambda y+\lambda c)-10$$

$\lambda c$ = Spectral absorption peak wave length (nm) of the colored cyan dye $\lambda m$ = Spectral absorption peak wave length (nm) of the colored magenta dye $\lambda y$ = Spectral absorption peak wave length (nm) of the colored yellow dye In the color print, improvement of the color reproduction and improvement of the observation light source dependency, which hitherto tend to conflict with each other, can be attained at the same time.

7 Claims, No Drawings

METHOD FOR PRODUCING A COLOR PRINT COMPRISING DEVELOPING A SPECIFIC MATERIAL WITHOUT BENZYL ALCOHOL

This application is a continuation of application Ser. No. 07/085,391, filed Aug. 14, 1987 abandoned.

BACKGROUND OF THE INVENTION

1. Field of the Invention

This invention relates to a color print and a method for producing the same, more specifically to a color print where even when the image was observed under different light sources the color balance does not get out of order, that is, a color print which has a small observation light source dependency, and a method for production thereof.

2. Description of the Prior Art

A silver halide color photosensitive material is a photosensitive material where three kinds of photosensitive layers which are respectively composed of silver halide emulsion layer(s) and are respectively selectively sensitized so as to have photosensitivity to blue light, green light and red light are coated on a support with a multilayered construction. For example, in a so-called color photographic paper (hereinafter referred to as color paper), red sensitive emulsion layer(s), green sensitive emulsion layer(s) and blue sensitive emulsion layer(s) and generally provided by coating in this order from the side to be exposed to light, and further in general an intermediate layer, a protective layer and the like are provided, for example between the respective photosensitive layers for inhibition of color mixing or absorption of ultraviolet rays.

Further, in a so-called color positive film, green sensitive emulsion layer(s), red sensitive emulsion layer(s) and blue sensitive emulsion layer(s) are generally provided by coating in this order from the furthest side from a support, i.e., from the side to be exposed to light. In a color negative film, various layer arrangements are possible, and it is general that a blue sensitive emulsion layer, green sensitive emulsion layer and red sensitive emulsion layer are provided by coating in this order from the side to be exposed to light. However, in a photosensitive material having 2 or more of emulsion layers which have the same color sensitivities but different speeds, there is sometimes found a case where an emulsion layer having a different color sensitivity is arrayed between the emulsion layers, and a yellow filter layer, an intermediate layer, a protective layer or the like each of which can be bleached is inserted.

In order to form a color photographic image, photographic couplers of three colors, i.e., yellow, magenta and cyan were made to be contained in the photosensitive layer, and the photosensitive material after exposure to light is color developed using a so-called color developing agent. The oxidized form of the aromatic primary amine is coupled with a coupler to give a colored dye, and the coupling rate is preferable to be as large as possible, and it is preferable that the colored dye is such a dye having good coloring property that give a high color density in a limited development time. Further, the colored dye is required to be a brilliant cyan, magenta or yellow dye having a low subabsorbing property and give a color photographic image of good color reproduction.

On the other hand, there is a possibility that the formed color photographic image, i.e., color print is observed under various light sources such as a sun light, a fluorescent lamp, a tungsten light and a mixed light thereof. The color print, is therefore, required to be an image composed of such a combination of the dyes that the balance of gray and other colors is not marred even when it is observed under any light source such as one above-mentioned (such a property is called observation light source dependency).

When a thing which is gray under a sun light is observed under a tungsten light, human eyes can recognize it to be gray. This is called color adaptation. In color reproduction by a so-called subtractive color process where all colors containing gray are reproduced by combinations of three primary colors, i.e., cyan, magenta and yellow, it has been known that a region of combinated colored dyes where color adaptation becomes impossible exists. In combination of dyes under such region, it occurs that an image which seems to be gray under a sun light seems to be reddish or greenish gray.

Such a phenomenon is a very undesirable thing for a color photographic image which may be observed under various light sources, and it is always desired to diminish such a dependency.

On the other hand, it is a supreme proposition to make clear reproduction good, and various efforts have been tried therefor. However, it has also been known in general that when the absorption spectrum of the colored dye is sharpened in order to make the color reproduction better, the observation light soucre dependency tends to become bad. Thus, development of a method for improving these properties at the same time has intensely been desired.

SUMMARY OF THE INVENTION

An object of the present invention is to provide such a color print having an improved observation light source dependency that gray is recognized as gray under various light sources such as a sun light, a fluorescent lamp and a tungsten light, and a method for production thereof.

An object of the present invention is particularly to provide a color print where both an epoch-making improvement of color reproduction in the region of from red to magenta and blue and an improvement of the observation light source dependency are accomplished, and a method for producing the same.

The above object of the present invention has been accomplished by a color print wherein colored dyes formed by coupling of at least one coupler represented by the following general formula (I) or (II), at least one coupler represented by the following general formula (III), and at least one coupler represented by the following general formula (IV), respectively with the oxidized form of a para-phenylenediamine developing agent and respectively contained in different hydrophilic colloidal layers as provided on a reflecting support by coating; the colored dyes respectively existing in droplets of a high boiling organic solvent and/or a water insoluble high molecular compound having a dielectric constant of 2 to 20 (25° C.) and a refractive index of 1.3 to 1.7 (25° C.), the grains being dispersed in the hydrophilic colloidal layers; and the spectral absorption peak wave lengths of the colored dyes respectively lying in the range represented by the following formula (I):

$$\tfrac{1}{2}(\lambda y+\lambda c) \geqq \lambda m \geqq \tfrac{1}{2}(\lambda y+\lambda c)-10 \qquad \text{(I)}$$

wherein

λc = Spectral absorption peak wave length (nm) of the colored cyan dye

λm = Spectral absorption peak wave length (nm) of the colored magenta dye

λy = Spectral absorption peak wave length (nm) of the colored yellow dye

The spectral absorption spectrum and spectral absorption peak wave length of the colored dye is almost determined by the structures of the used couplers and color developing agent, and the physical properties of high boiling solvent(s) to be used as dispersion medium(s) of the dyes, especially the dielectric property and refractive index (The Journal of Physical Chemistry, 61, 562 (1957)). It is further possible in some extent to change the sharpness of the absorption by changing the ratio of the high boiling solvent with each coupler.

It is first necessary to sharpen the absorption spectrum of the colored dye in order to enhance the brilliantness of the color by improving the color reproduction. Particularly for regions such as red, purple and blue which are important as color reproduction regions, it is preferable to diminish subabsorption particularly in the cyan region and yellow region of the magenta dye as much as possible. Three factors were mentioned as factors which greatly govern the spectral absorption characteristics of the colored dye, and the most governing factor is coupler. It has been found that by using a coupler represented by the general formula (III) the subabsorption in the cyan and yellow regions is remarkably diminished, and at the same time the saturation of the region of from red to blue via purple is enhanced and the region where color reproduction is possible is greatly extended. However, it has been found that the improvement of color reproduction using a coupler represented by the general formula (III) makes the observation light source dependency remarkably worse at the same time. The extent of deterioration of the dependency was far beyond the level generally forecast as the result of the spectral absorption characteristics of the colored dye was sharpened. As for observation light source dependency, there is a detailed description in The Journal of Photographic Science, 20, 149 (1972). In the literature, by using a colored dye which is used in a conventional color photograph, relations between the absorption wave length peaks of the respective dyes which give the best observation light source dependency are determined. The relations exhibited therein are shown below as the formulae (II) and (III):

$$\lambda y \approx \lambda m - 90 \quad \text{(II)}$$

$$\lambda m \approx 3/5\lambda c + 140 \quad \text{(III)}$$

The present inventors have produced a color photographic photosensitive material wherein the relations of the formulae (II) and (III) are satisfied by using a coupler represented by the general formula(e) (I) and/or (II), a coupler represented by the general formula (III) and a coupler represented by the general formula (IV) and changing their structures, the polarity of a high boiling solvent used as a dispersion medium thereof, use ratio of the solvent to each coupler and the like. Nevertheless, the observation light source dependency has been held remarkably worse. The present inventors have further investigated the observation light source dependencies of samples where the peak wave lengths of these colored dyes are changed, and have found that the optimun region for holding the observation light source dependency small exists in a place utterly different from the region shown by the formulae (II) and (III). It has been found that the optimum region is exhibited by the formula (I) and has relation to the spectral absorption peak wave lengths of the cyan-, magenta-and yellow-colored dyes. This discovery was utterly unexpected thing, and the discovery has made the invention possible which exceeds the usual conception in epochally improving the color reproduction and simultaneously improving the observation light source dependency.

Spectral absorption peak wave lengths which the cyan-colored dye, the magenta-colored dye and the yellow-colored dye may have as preferred ones in the present invention are respectively 665±15nm, 542.5±15nm and 440±15nm, further preferably 665±10nm, 542.5±10nm and 440±10nm.

Couplers to be used in combination thereof in the present invention and explained below in detail.

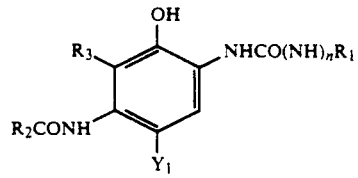

(I)

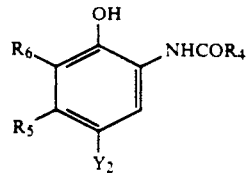

(II)

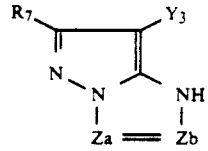

(III)

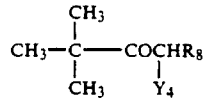

(IV)

In the general formulae (I) to (IV) $R_1$, $R_2$ and $R_4$ independently represent substituted or unsubstituted aliphatic, aromatic or heterocyclic groups; $R_3$, $R_5$ and $R_6$ independently represent hydrogen atoms, halogen atoms, substituted or unsubstituted, aliphatic, aromatic or acylamino groups, and $R_3$ may represent with $R_2$ a nonmetal atomic group which forms a nitrogen-containing 5- or 6-membered ring; $R_7$ represents a hydrogen atom or a substituent; $R_8$ represents a substituted or unsubstituted N-phenylcarbamoyl group; $Z_a$, $Z_b$ and $Z_c$ independently represent methines, substituted methines, =N— or —NH—; n is 0 or 1; and $Y_1$, $Y_2$, $Y_3$ and $Y_4$ independently represent hydrogen atoms or groups eliminable at the coupling reaction with the oxidized form of the developing agent.

When $Y_1$, $Y_2$, $Y_3$ or $Y_4$ in the above general formula (I), (II), (III) or (IV) represents a coupling-off group, the coupling-off group is such a group that bonds the coupling active carbon to an aliphatic group, an aromatic group, a heterocyclic group, an aliphatic, aromatic or heterocyclic sulfonyl group, or an aliphatic, aromatic or heterocyclic carbonyl group through an oxygen, nitrogen, sulfur or carbon atom; a halogen atom; an aromatic azo group; or the like. The aliphatic, aromatic or heterocyclic group contained in these eliminable groups may be substituted with substituent(s) permitted for $R_1$, and when there are two or more of these substituents, they may be the same or different and these substituents may further have substituent(s) permitted for $R_1$.

Examples of the coupling-off group include a halogen atom (for example, a fluorine, chlorine or bromine atom), an alkoxy group (for example, ethoxy, dodecyloxy, methoxyethylcarbamoylmethoxy, carboxypropyloxy or methylsulfonylethoxy group), an aryloxy group (for example, a 4-chlorophenoxy, 4-methoxyphenoxy or 4-carboxyphenoxy group), an acyloxy group (for example, an acetoxy, tetradecanoyloxy or benzoyloxy group) an aliphatic or aromatic sulfonyloxy group (for example, a methanesulfonyloxy or toluenesulfonyloxy group) an acylamino group (for example, a dichloroacetylamino or heptafluorobutyrylamino group) an aliphatic or aromatic sulfonamido group (for example, a methanesulfonamino or p-toluenesulfonylamino group), an alkoxycarbonyloxy group (for example, an ethoxycarbonyloxy or benzyloxycarbonyloxy group) an aryloxycarbonyloxy group (for example, a phenoxycarbonyloxy group), an aliphatic, aromatic or heterocyclic thio group (for example, an ethylthio, phenylthio or tetrazolylthio group), a carbamoylamino group (for example, an N-methylcarbamoylamino or N-phenylcarbamoylamino group), a 5- or 6-membered nitrogen-containing heterocyclic group (for example, an imidazolyl, pyrazolyl, triazolyl, tetrazolyl or 1,2-dihydro-2-oxo-1-pyridyl group), an imido group (for example, a succinimido or hydantoinyl group), an aromatic azo group (for example, a phenylazo group) and the like, and these groups may respectively be substituted with group(s) permitted as substituent(s) of $R_1$. Further, there is a bis type coupler as the eliminable group which bonds through carbon atom(s), which coupler is obtained by condensing a 4-equivalent coupler with an aldehyde or a ketone. The coupling-off group of a coupler to be used in the present invention may contain a photographically useful group such as a development-inhibiting group or a development-accelerating group. Combinations of coupling-off groups preferred in the respective general formulae are hereinafter described.

In the definition of $R_1$, $R_2$ and $R_4$ in the cyan couplers of the general formulae (I) and (II), the aliphatic group having 1 to 32 carbon number includes for example a methyl, butyl, tridecyl, cyclohexyl or aryl group; the aryl group includes for example a phenyl or naphthyl group; and the heterocyclic group includes for example a 2-pyridyl, 2-imidazolyl, 2-furyl or 6-quinolyl group. Each of these groups may be substituted by a group selected from an alkyl group, an aryl group, a heterocyclic group, an alkoxy group (for example, a methoxy or 2-methoxyethoxy group), an aryloxy group (for example, a 2,4-di-tert-aminophenoxy, 2-chlorophenoxy or 4-cyanophenoxy group), an alkenyloxy group (for example, a 2-propenyloxy group) an acyl group (for example, an acetyl or benzoyl group) an ester group (for example, a butoxycarbonyl, phenoxycarbonyl, acetoxy, benzoyloxy, butoxysulfonyl or toluenesulfonyloxy group) an amido group (for example, an acetylamino, methanesulfonamido or dipropylsulfamoylamino group), a carbamoyl group (for example, a dimethylcarbamoyl or ethylcarbamoyl group), a sulfamoyl group (for example, a butylsulfamoyl group), an imido group (for example, a succinimido or hydantoinyl group), an ureido group (for example, a phenylureido or dimethylureido group), an aliphatic or aromatic sulfonyl group (for example, a methanesulfonyl or phenylsulfonyl group), an aliphatic or aromatic thio group (for example, an ethylthio or phenylthio group), a hydroxy group, a cyano group, a carboxy group, a nitro group, a sulfo group, a halogen atom and the like.

When $R_3$ and $R_5$ in the general formula (I) are respectively substituents which can be substituted, they may respectively be substituted with a substituent which is mentioned in $R_1$as a substituent which can be substituted.

$R_5$ in general formula (II) is preferably an aliphatic group and includes for example, a methyl, ethyl, propyl, butyl, pentadecyl, tert-butyl, cyclohexyl, cyclohexylmethyl, phenylthiomethyl, dodecyloxyphenylthiomethyl, butanamidomethyl or methoxymethyl group.

$Y_1$ and $Y_2$ in the general formulae (I) and (II) independently represent hydrogen atom or coupling-off groups (including coupling-off atoms. This is applied as well in the following description). Examples of the coupling-off group include a halogen atom (for example, a fluorine, chlorine or bromine atom), an alkoxy group (for example, an ethoxy, dodecyloxy, methoxyethylcarbamoylmethoxy, carboxypropyloxy or methylsulfonylethoxy group), an aryloxy group (for example, a 4-chlorophenoxy, 4-methoxyphenoxy or 4-carboxyphenoxy group), an acyloxy group (for example, an acetoxy, tetradecanoyloxy or benzoyloxy group), a sulfonyloxy group (for example, a methanesulfonyloxy or toluenesulfonyloxy group), an amido group (for example, a dichloroacetylamino, heptafluorobutyrylamino, methanesulfonylamino or toluenesulfonylamino group), an alkoxycarbonyloxy group (for example, an ethoxycarbonyloxy or benzyloxycarbonyloxy group), an aryloxycarbonyloxy group (for example, a phenoxycarbonyloxy group), an aliphatic or aromatic thio group (for example, an ethylthio, phenylthio or tetrazolylthio group), an imido group (for example, a succinimido or hydantoinyl group), an aromatic azo group (for example, a phenylazo group) and the like. These coupling-off groups may contain a group useful for photography.

Preferred examples of the cyan couplers represented by the above general formula (I) or (II) are as follows:

Preferred examples of $R_1$ in the general formula (I) include an aryl group and a heterocyclic group, and an aryl group substituted with a halogen atom, or an alkyl, alkoxy, aryloxy, acylamino, acyl, carbamoyl, sulfonamido, sulfamoyl, sulfonyl, sulfamido, oxycarbonyl or cyano group is further preferable as $R_1$.

When $R_3$ and $R_2$ do not combine to form a ring in the general formula (I), $R_2$ is preferably a substituted or unsubstituted alkyl group or an aryl group, particularly an alkyl group substituted with a substituted aryloxy group, and $R_3$ is preferably a hydrogen atom.

In the general formula (II), preferred $R_4$ includes a substituted or unsubstituted alkyl or aryl group, and particularly preferred $R_4$ includes an alkyl group substituted with a substituted aryloxy group.

In the general formula (II), preferred $R_5$ includes an alkyl group having 2 to 15 carbon atoms or a methyl group having a substituent which has one more carbon atoms, and an arylthio, alkylthio, acylthio, aryloxy or alkyloxy group is preferable as the substituent. Further preferred $R_5$ includes an alkyl group having 2 to 15 carbon atoms, and particularly preferred $R_5$ includes an alkyl group having 2 to 4 carbon atoms.

Preferred $R_6$ in the general formula (II) includes a hydrogen atom or a chlorine atom, and particularly preferred $R_6$ includes a chlorine atom or a fluorine atom.

Preferred $Y_1$ and $Y_2$ in the general formulae (I) and (II) include respectively hydrogen atoms, halogen atoms, alkoxy groups, aryloxy groups, acyloxy groups or sulfonamido groups. Further preferred $Y_2$ in the general formula (II) includes a halogen atom, and particularly preferred $Y_2$ include a chlorine atom or a fluorine atom, when n is zero in the general formula (I), further preferred $Y_1$, includes a halogen atom, and particularly preferred $Y_1$ includes a fluroine atom.

The substituents in the general formula (III) are explained below. $R_7$ represents a hydrogen atom or a substituent. Examples of such the substituent include an aliphatic group, an aromatic group, a heterocylic group, an alkoxy group, an aryloxy group, a heterocyclic oxy group and other groups as disclosed in U.S. Pat. No. 4,540,654, col. 2 line 41 to col. 4 line 29. Preferred $R_4$ includes an alkyl group, an alkoxy group, an aryloxy group and a heterocyclic oxy group, each of which may be substituted with group(s) as referred to the substituent of $R_1$. More specifically, the alkyl group in $R_7$ includes, for example, a straight chain or branched chain alkyl group preferably having from 1 to 32 carbon atoms, an aralkyl group and a cycloalkyl group. e.g., a methyl, ethyl, propyl, iso-propyl, iso-butyl, t-butyl, trifluoromethyl, tridecyl, 2-methanesulfonyl ethyl, 3-(3-pentadecylphenoxy)propyl, 3{4-{2-[4-(4-hydroxyphenylsulfonyl) phenoxy-]dodecaneamido}phenyl}propyl, 2-ethoxytridecyl, cyclopentyl and 3-(2,4-di-t-amylphenoxy)propyl group. The alkoxy group in $R_7$ includes, for example, a methoxy, ethoxy, i-propoxy, hexyloxy, t-butoxy, dodecyloxy, 2-ethylhexyloxy, benzyloxy, cyclohexyloxy, 2-chloroethoxy, 2-phenoxyethoxy, 2-(2,4-dichlorophenoxy)ethoxy or allyloxy; the aryloxy group in $R_7$ includes, for example, a phenoxy, 2,4-dichlorophenoxy, 4-methylphenoxy, 4-nonylphenoxy, 3-pentadecylphenoxy, 3-butanamidophenoxy, 2-naphthoxy, 1-naphthoxy, a4-methoxyphenoxy, 3,5-dimethoxyphenoxy or 3-cyanophenoxy group; and the heterocyclic oxy group in $R^7$ includes, for example, a 2-pyridyloxy, 2-thienyloxy, 2-methyltetrazole-5-oxy, 2-benzothiozoleoxy or 2-pyrimidineoxy group.

$Y_3$ in the general formula (III) represents a hydrogen atom or a coupling-off group. Examples of the coupling-off group in $Y_3$ include, a halogen atom (for example, a fluorine or chlorine atom), an alkoxy group (for example, a methoxy, ethoxy, dodecyloxy, methoxyethylcarbamoylmethoxy or methylsulfonylethoxy group), an arylthio group (for example, a phenoxy, 4-methylphenoxy, 4-methoxyphenoxy, 4-t-butylphenoxy, 4-carboethoxyphenoxy, 4-cyanophenoxy or 2,4-dichlorophenoxy group), an acyloxy group (for example, an acetoxy or tetradecanoyloxy group) an amido group (for example, a dichloroacetoamido, benzenesulfonylamino or trifluoroacetamido group), an imido group (for example, a succinimido, phthalimido, 5,5-dimethyl-2,4-dioxooxazolidinyl or 1-benzyl-5-ethoxyhydantoinyl group), a nitrogen-containing heterocyclic group (for example, a pyrazolyl, 4-chloropyrazolyl, 3,5-dimethyl-1,2,4-triazol-2-yl or imidazolyl, 3-chloro-1,2,4-triazol-2-yl group), an alkylthio group (for example, an ethylthio, dodecylthio, 1-ethoxycarbonyldodecylthio, 3-phenoxypropylthio or 2-(2,4-tert-aminophenoxy)ethoxy group), an arylthio group (for example, a phenylthio, 2-butoxy-5-tertoctylphenylthio, 4-dodecyloxyphenylthio, 2-(2-ethoxyethoxy)-5-tert-octylphenylthio, 3-pentadecylphenylthio, 3-octyloxyphenylthio, 3-(N,N-didodecylcarbamoyl) phenylthio or 2-octyloxo-5-chloro-phenylthio group), and a heterocyclic thio group (for example, a 1-phenyltetrazole-5-thio, 1-ethyltetrazole-5-thio or 1-dodecyl-1,2,4-triazole-5-thio group). Preferred coupling-off group among those described above is a group which is eliminated as a mercapto group, and particularly preferred one is an arylthio group.

$Z_a$ and $Z_b$ in the general formula (IV) respectively represent methine, substituted methine, —N= or —NH— group.

Preferred couplers among the magenta couplers of the general formula (III) are those represented by the following general formulae (III-1) to (III-4).

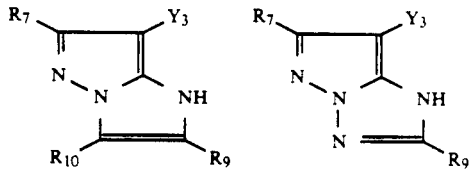

(III-1)

(III-2)

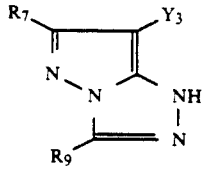

(III-3)

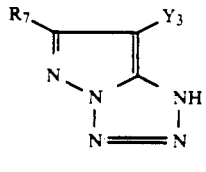

(III-4)

Further preferred couplers among them are those represented by the general formulae (III-2) and (III-3), and particularly preferred ones are those represented by the general formula (III-2). $R_7$ has the same meanings as mentioned before.

$R_9$ and $R_{10}$ in the general formulae (III-1) to (III-4) may be the same or different and respectively represent hydrogen atoms, halogen atoms, alkyl groups, aryl groups, heterocyclic groups, cyano groups, alkoxy groups, aryloxy groups, heterocyclic oxy groups, acyloxy groups, carbamoyloxy groups, silyloxy groups, sulfonyloxy groups, acylamino groups, arilino groups, ureido groups, imido groups, sulfamoylamino groups, carbamoylamino groups, alkylthio groups, arylthio groups, heterocyclic thio groups, alkoxycarbonylamino groups, aryloxycarbonylamino groups sulfonamido groups, carbamoyl groups, acyl groups, sulfamoyl groups, sulfonyl groups, sulfinyl groups, alkoxycarbonyl groups, or aryloxycarbonyl groups. $R_9$, $R_{10}$ or $Y_3$ may become a bivalent group so as to make a bis type coupler.

More specifically, $R_9$ and $R_{10}$ respectively represent hydrogen atoms, halogen atoms (for example, chlorine or bromine atoms), alkyl groups (for example, methyl, propyl, t-butyl, trifluoromethyl, tridecyl, 3-(2,4-di-t-aminophenoxy)propyl, allyl, 2-dodecyloxyethyl, 3phenoxypropyl, 2-hexylsulfonyl-ethyl, cyclopentyl, or benzyl groups), aryl groups (for example, phenyl, 4-t-butylphenyl, 2,4-di-t-aminophenyl or 4-tetradecanamidophenyl groups), heterocyclic groups (for example, 2-furyl, 2-thienyl, 2-pyrimidinyl or 2-benzothiazolyl groups), cyano groups, alkoxy groups (for example, methoxy, ethoxy, 2-methoxyethoxy, 2-dodecyloxyethoxy or 2-methanesulfonylethoxy groups), aryloxy groups (for example, phenoxy 2-methylphenoxy or 4-t-butylphenoxy groups), hetarocyclic oxy groups (for example, 2-benzimidazolyloxy groups), acyloxy groups (for example, acetoxy or hexadecanoyloxy groups), carbamoyloxy groups (for example, N-phenylcarbamoyloxy or N-ethylcarbamoyloxy groups), silyloxy groups (for example, trimethylsilyloxy groups), sulfonyloxy groups (for example, dodecylsulfonyloxy groups) acylamino groups (for example, acetamido, benzamido, tetradecanamido, α-(2,4-di-t-aminophenoxy)butylamido, α-(3-t-butyl-4-hydroxyphenoxy)-butyramido, or α-{4-(4-hydroxyphenylsulfonyl)-phenoxy{decanamido group), anilino groups (for example, phenylamino, 2-chloroanilino, 2-chloro-5-tetradecanamidoanilino 2-chloro-5-dodecyloxycarbonylanilino, N-acetylanilino, or 2-chloro-5-{α-(3-t-butyl-4-hydroxyphenoxy)dodecanamido}anilino groups), ureido groups (for example, phenylureido, methylureido or N,N-dibutylureido groups), imido groups (for example, N-succinimido, 3-benzylhydantoinyl or 4-(2-ethylhexanoylamino) phthalimido groups), sulfamoylamino groups (for example, N,N-dipropylsulfamoylamino or N-methyl-N-decylsulfamoylamino groups), alkylthio groups (for example, methylthio, octylthio, tetradecylthio, 2-phenoxyethylthio, 3-phenoxypropylthio, or 3-(4-t-butylphenoxy)propylthio groups), arylthio groups (for example, phenylthio, 2-butoxy-5-t-octylphenylthio, 3-pentadecylphenylthio, 2-carboxyphenylthio or 4-tetradecanamidophenylthio groups), heterocyclic thio groups (for example, 2-benzothiazolylthio groups), alkoxycarbonylamino groups (for example, methoxycarbonylamino or tetradecyloxycarbonylamino groups), aryloxycarbonylamino groups (for example, phenoxycarbonylamino or 2,4-ditertbutylphenoxycarbonylamino groups), sulfonamido groups (for example, methanesulfonamido, hexadecansulfonamido, benzensulfonamido, P-toluenesulfonamido, octadecansulfonamido or 2-methyloxy-5-t-butylbenzenesulfonamido groups), carbamoyl groups (for example, N-ethylcarbamoyl, N,N-dibutylcarbamoyl, N-(2-dodecyloxyethyl)carbamoyl, N-methyl-N-dodecylcarbamoyl or N-{3-(2,4-di-tert-amylphenoxy)-propyl}carbamoyl groups), acyl groups (for example, acetyl, (2,4-di-tert-amylphenoxy)acetyl or benzoyl groups), sulfamoyl groups (for example, N-ethylsulfamoyl, N,N-dipropylsulfamoyl, N-(2-dodecyloxyethyl)sulfamoyl, N-ethyl-N-dodecylsulfamoyl, or N,N-diethylsufamoyl groups), sulfonyl groups (for example, methanesulfonyl, octanesulfonyl, benzenesulfonyl or toluenesulfonyl groups), sulfinyl groups (for example, octanesulfinyl, dodecylsulfinyl or phenylsulfinyl groups), alkoxycarbonyl groups (for example, methoxycarbonyl, butyloxycarbonyl, dodecylcarbonyl or octadecylcarbonyl groups), or aryloxycarbonyl groups (for example, phenyloxycarbonyl or 3-pentadecyloxycarbonyl groups).

The substituents of the phenyl group of the N-phenylcarbamoyl group ($R_8$) in the general formula (IV) can freely be selected from the group of the substituents permitted for the aforementioned $R_1$, and when there are two or more substituents therefor, they may be the same or different.

A group represented by the following general formula (IV A) is mentioned as preferred $R_8$.

General formula (IV A)

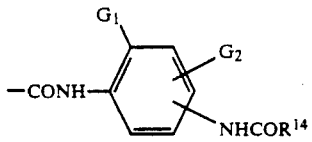

wherein $G_1$ represents a halogen atom or an alkoxy group, $G_2$ represents a hydrogen atom, a halogen atom or an alkoxy group optionally having a substituent, and $R^{14}$ represents an alkyl group optionally having a substituent.

Typical examples of the substituents of $G_2$ and $R^{14}$ in the general formula (IV A) respectively include alkyl groups, alkoxy groups, aryl groups, aryloxy groups, amino groups, dialkylamino groups, heterocyclic groups (for example N-morpholino, N-piperidino or 2-furyl groups), halogen atoms, nitro groups, hydroxy groups, carboxyl groups, sulfo groups, alkoxycarbonyl groups and the like.

A preferred group as the coupling-off group $Y_4$ is any one of the groups represented by the following formulae (X) to (XVI):

(X)

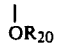

wherein $R_{20}$ represents an optionally substituted aryl or heterocyclic group;

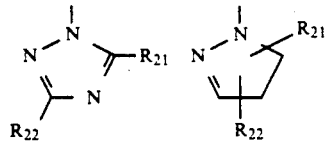

(XI) (XII)

wherein $R_{21}$ and $R_{22}$ may be the same or different, and respectively represent hydrogen atoms, halogen atoms, carboxylic ester groups, amino groups, alkyl groups, alkylthio groups, alkoxy groups, alkylsufonyl groups, alkylsulfinyl groups, carboxylic acid groups, sulfonic acid groups, or unsubstituted or substituted phenyl or heterocyclic groups.

(XIII)

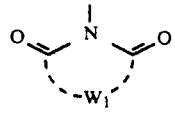

wherein $W_1$ in combination with

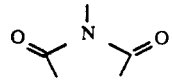

in the formula represents a nonmetal atomic group necessary for forming a 5- or 6-membered ring.

Preferred groups among the groups represented by the general formula (XIV) include those represented by the general formulae (XIV) to (XVI):

(XIV)

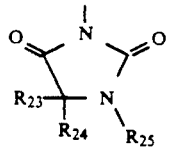

(XV)

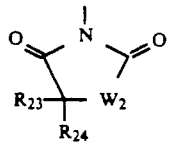

-continued (XVI)

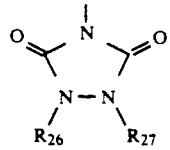

wherein $R_{23}$ and $R_{24}$ may be the same or different, and respectively represent hydrogen atoms, alkyl groups, aryl groups, alkoxy groups, aryloxy groups, or hydroxy groups; $R_{25}$, $R_{26}$ and $R_{27}$ may be the same or different, and respectively represent hydrogen atoms, alkyl groups, aryl groups, aralkyl groups or acyl groups; and $W_2$ represents an oxygen or sulfur atom.

Specific examples of these couplers are enumerated below.

(I

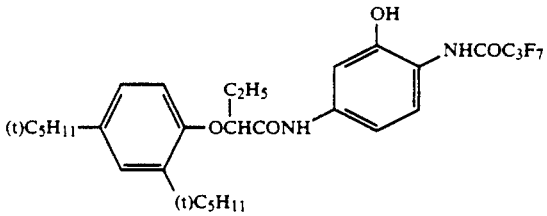

(I

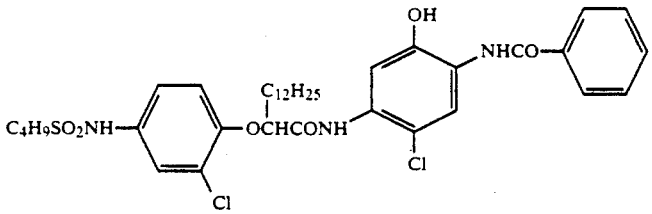

(I

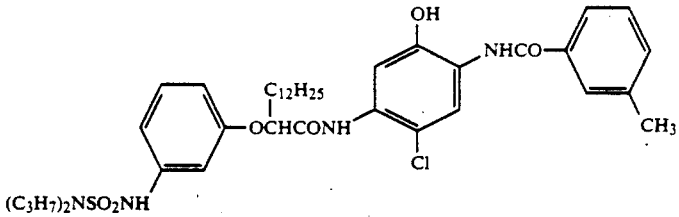

(I

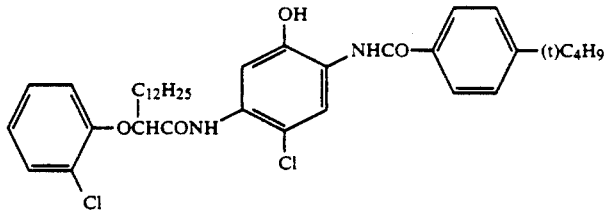

(I

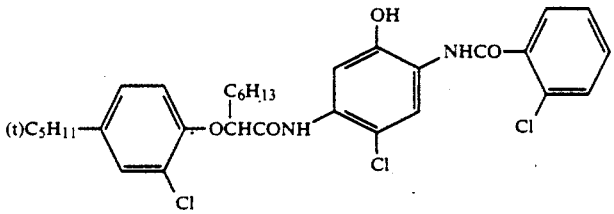

-continued
(I-6)
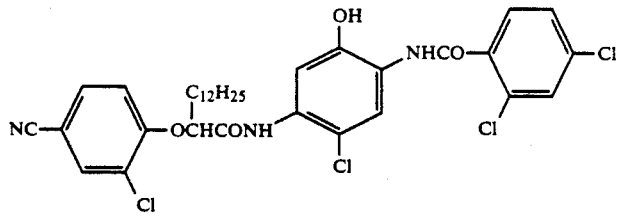
(I-7)
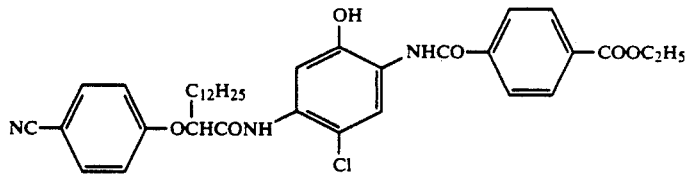
(I-8)
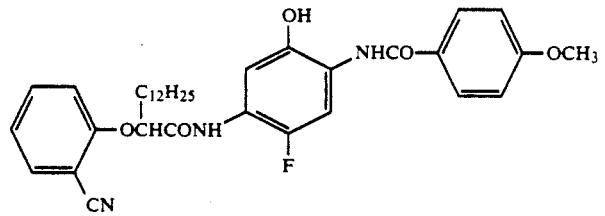
(I-9)
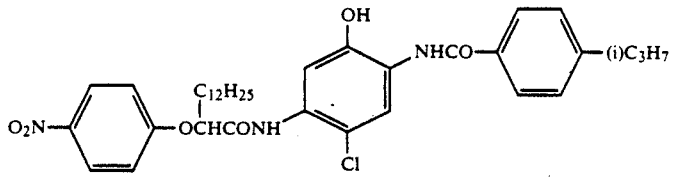
(I-10)
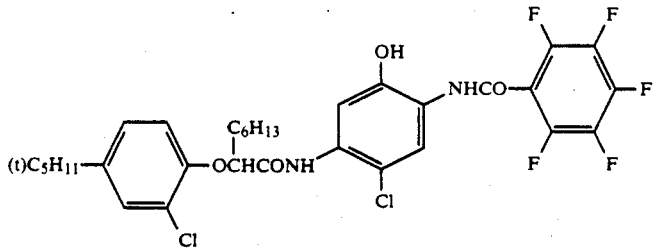
(I-11)
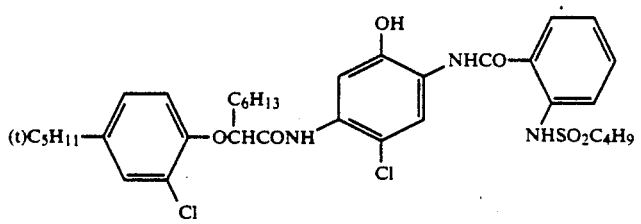
(I-12)
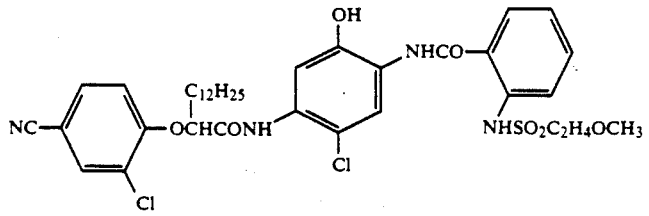

-continued
(I-13)
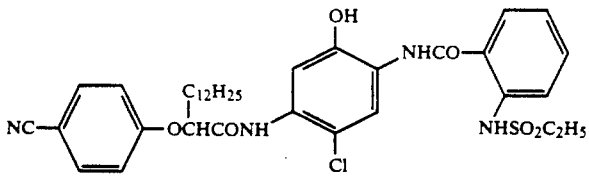
(I-14)
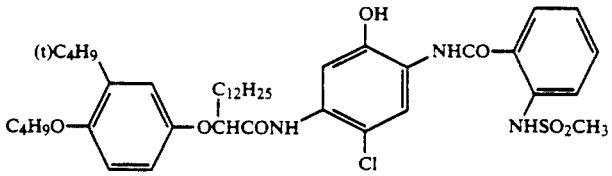
(I-15)
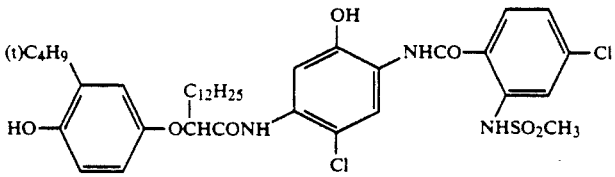
(I-16)
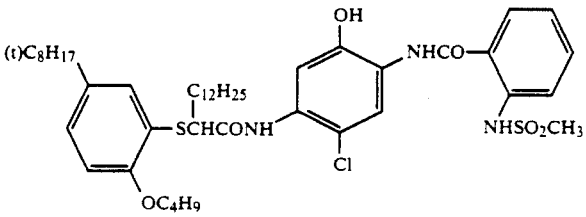
(I-17)
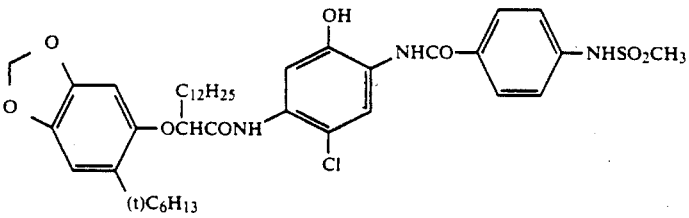
(I-18)
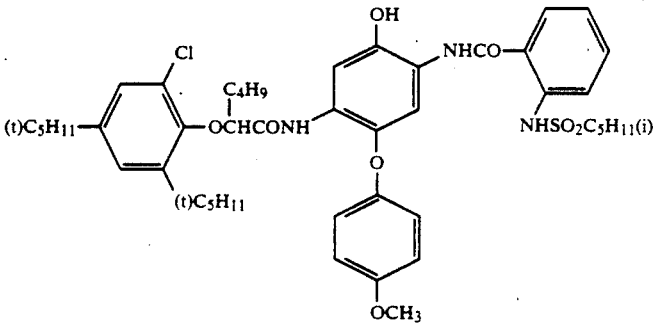
(I-19)
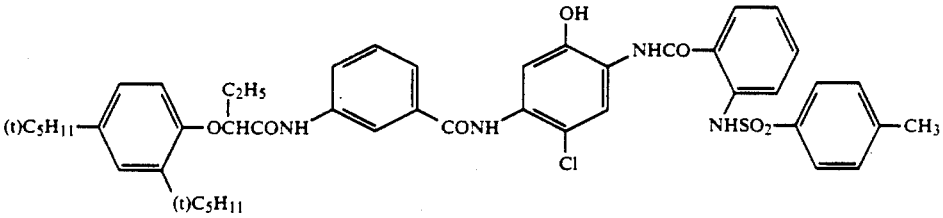

-continued
(I-20)
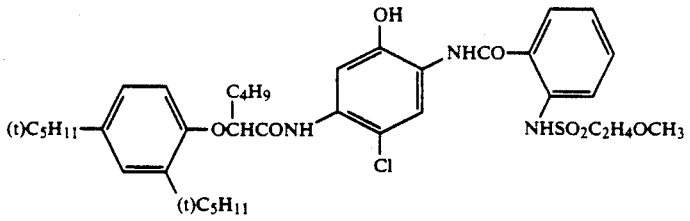
(I-21)
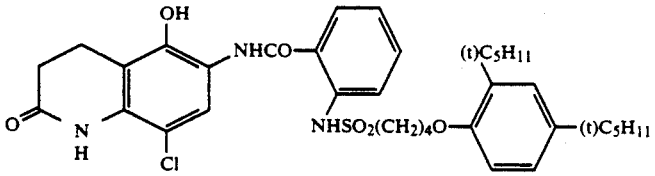
(I-22)
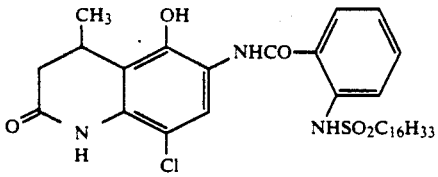
(I-23)
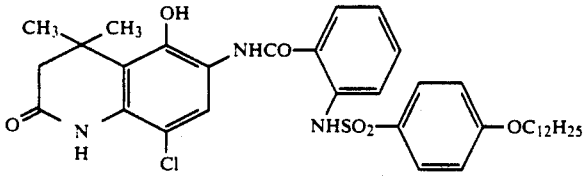
(I-24)
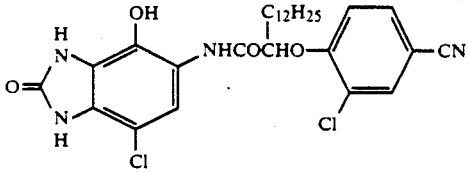
(I-25)
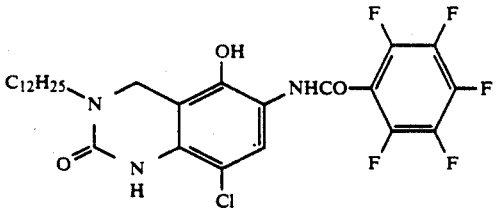
(I-26)
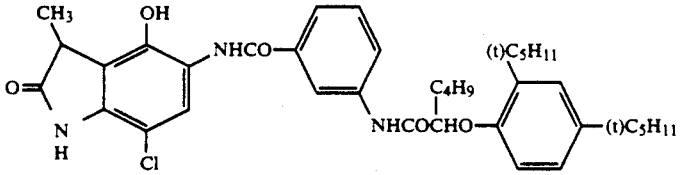
(I-27)
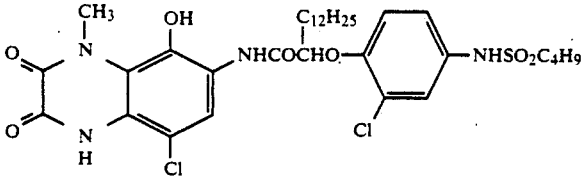

-continued
(I-28)
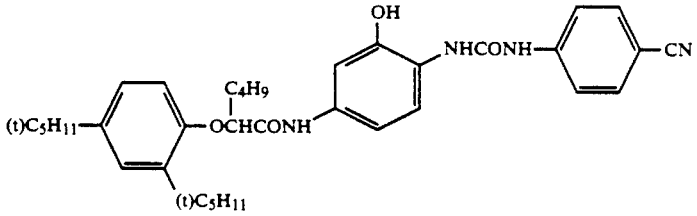
(I-29)
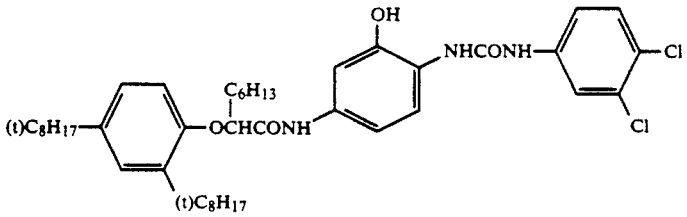
(I-30)
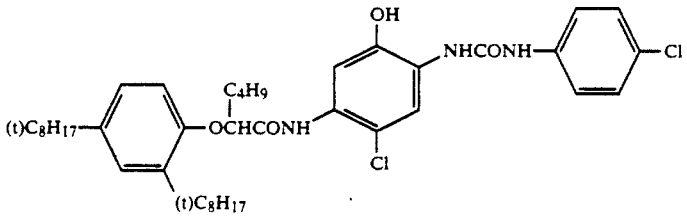
(I-31)
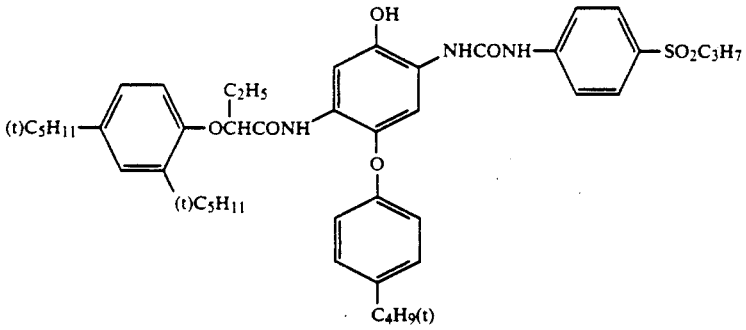
(I-32)
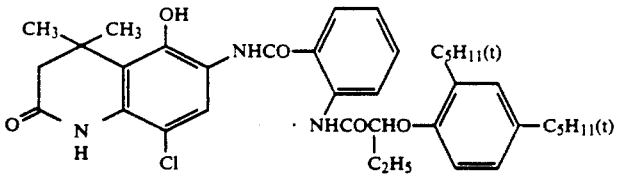
(I-33)
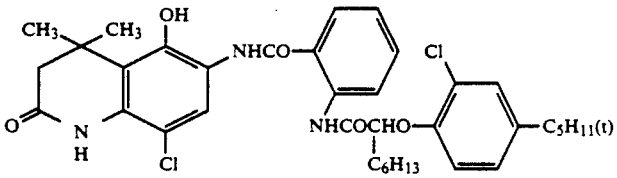
(I-34)
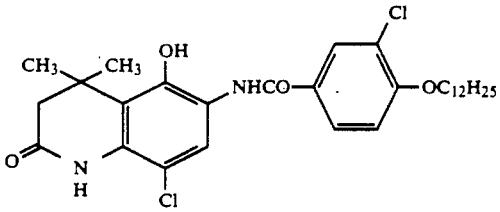

-continued
(I-35)
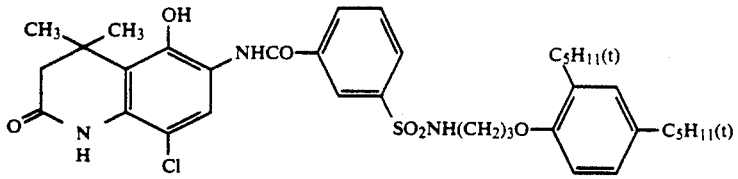
(I-36)
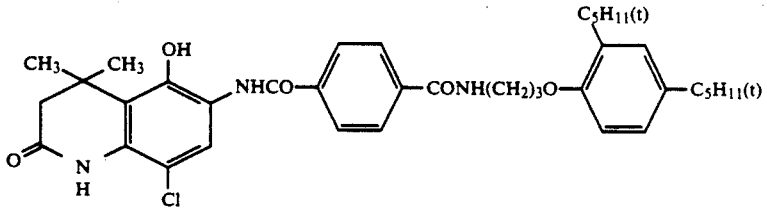
(I-37)
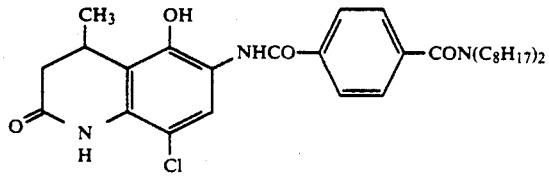
(I-38)
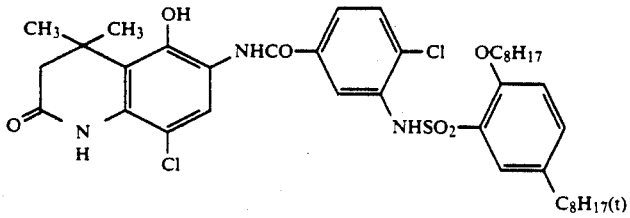
(I-39)
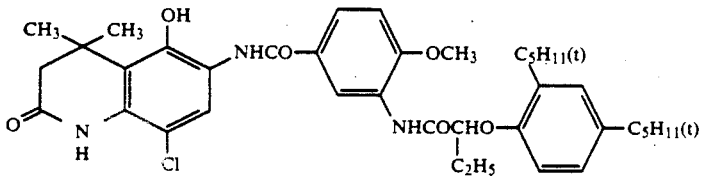
(I-40)
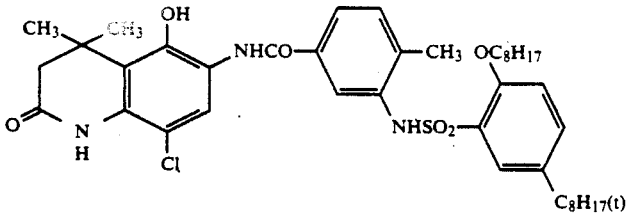
(I-41)
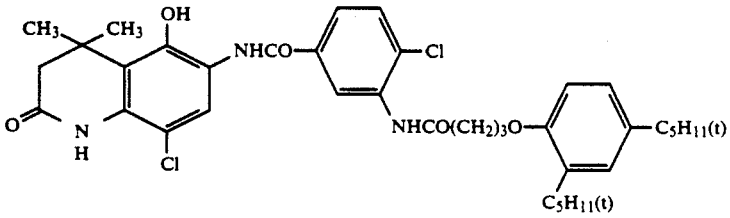
(I-42)
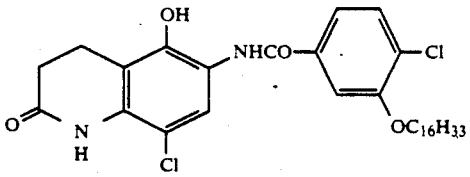

-continued
(I-43)
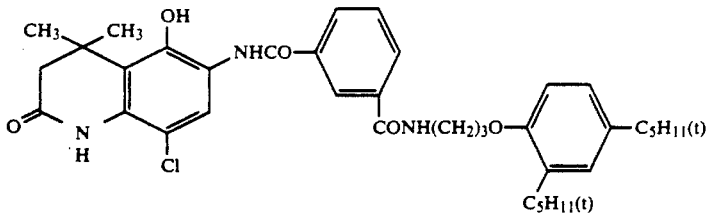
(I-44)
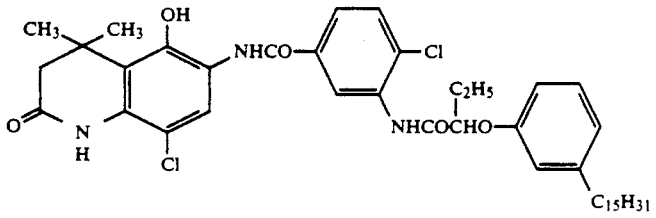
(I-45)
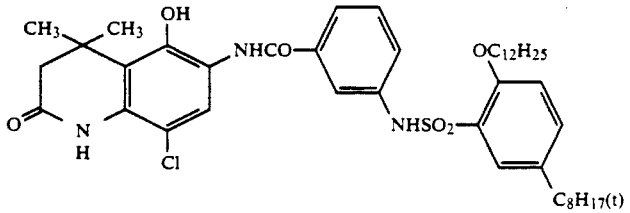
(I-46)
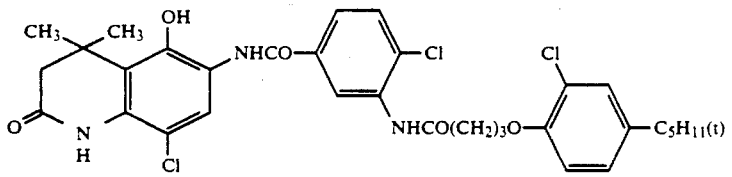
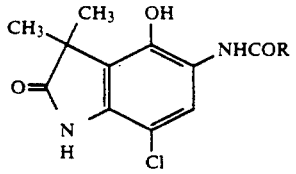
(I-47)
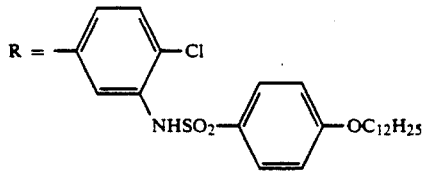
(I-48)
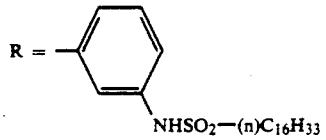
(I-49)
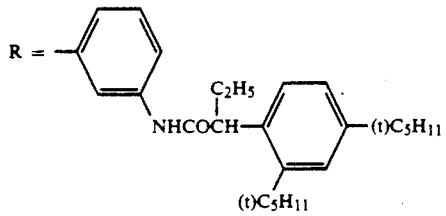

-continued
(I-50)
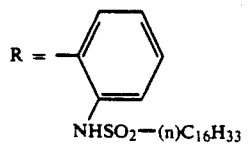
(I-51)
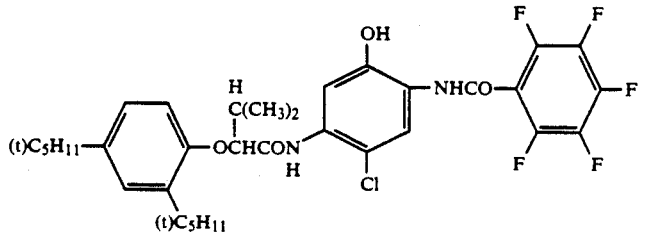
-(II)
(II-1)
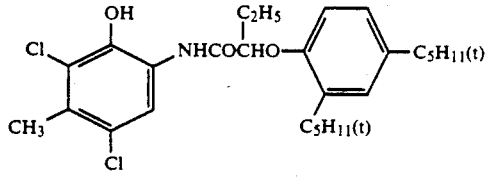
(II-2)
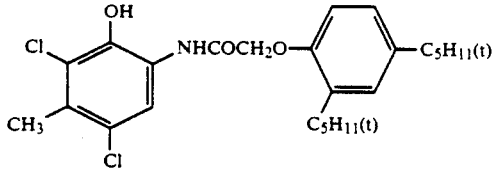
(II-3)
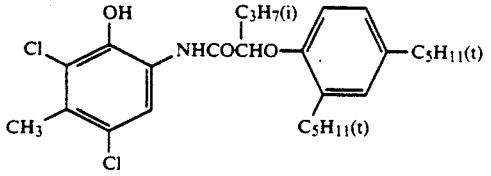
(II-4)
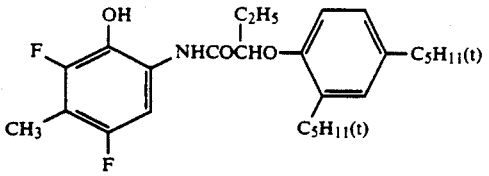
(II-5)
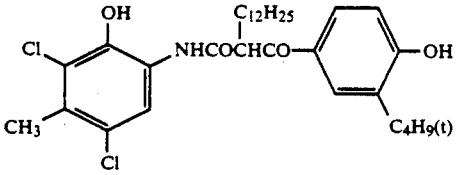
(II-6)
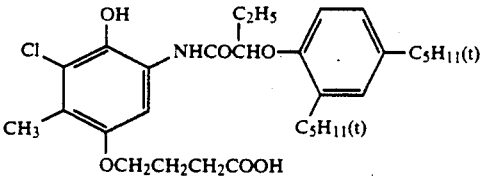

-continued
(II-7)
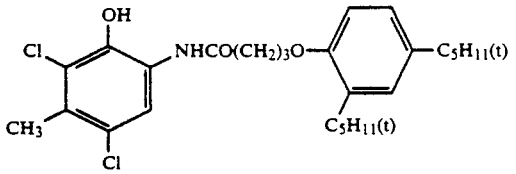
(II-8)
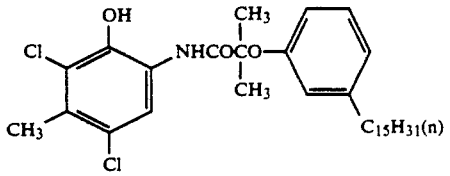
(II-9)
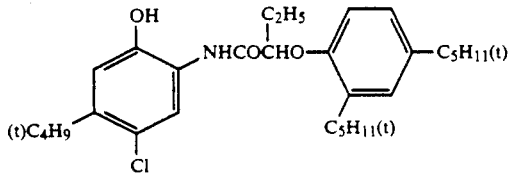
(II-10)
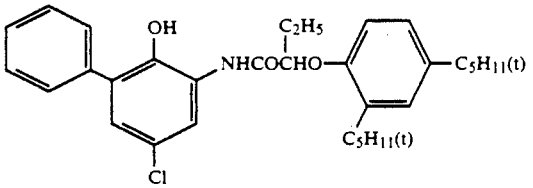
(II-11)
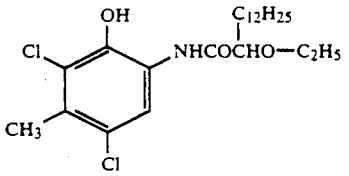
(II-12)
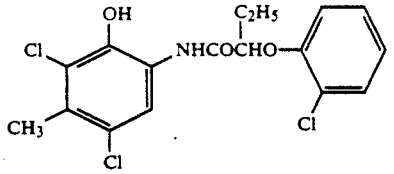
(II-13)
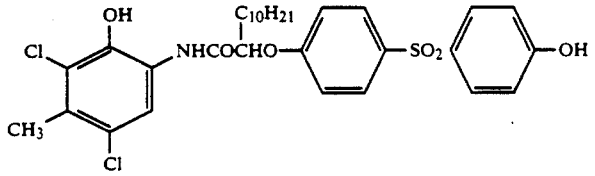
(II-14)
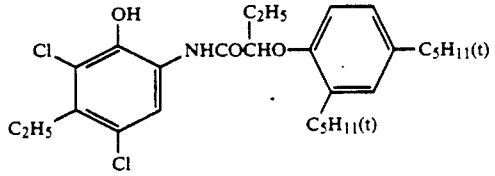

-continued
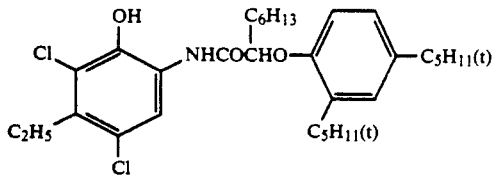
(II-15)
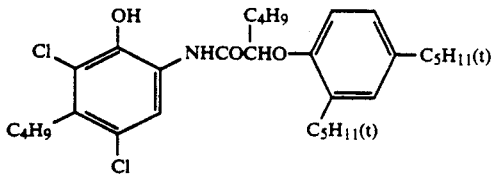
(II-16)
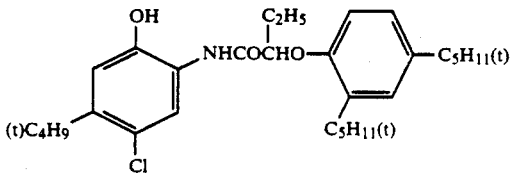
(II-17)
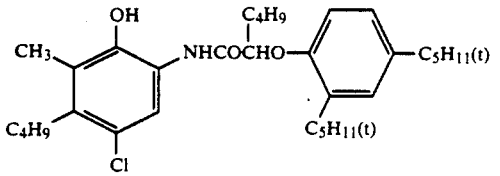
(II-18)
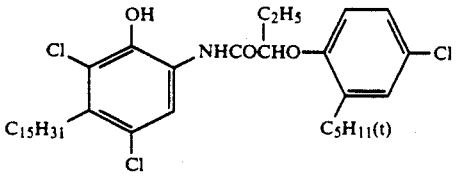
(II-19)
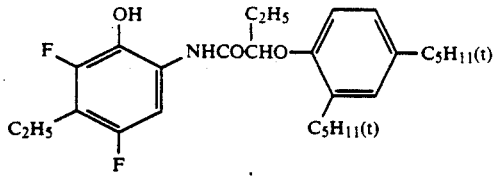
(II-20)
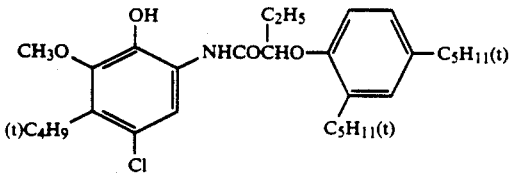
(II-21)
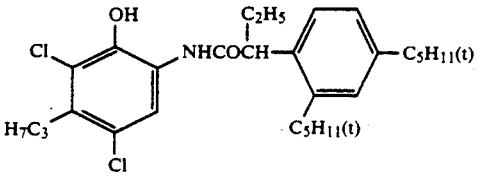
(II-22)

-continued
(II-23)
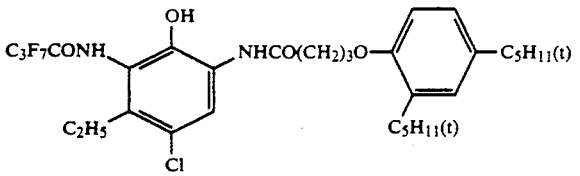
(II-24)
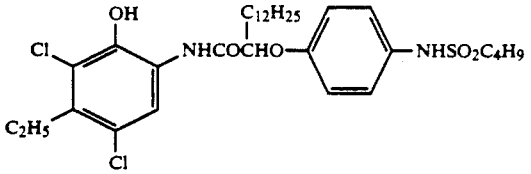
(II-25)
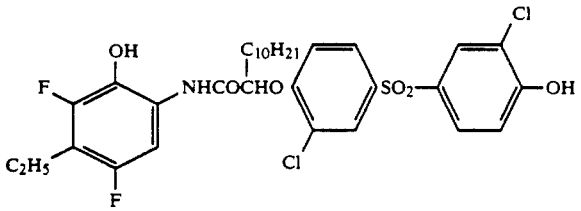
(II-26)
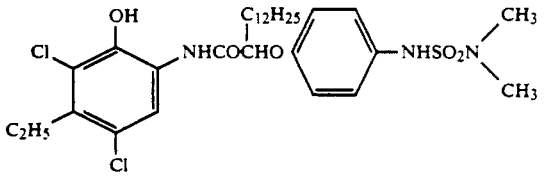
(II-27)
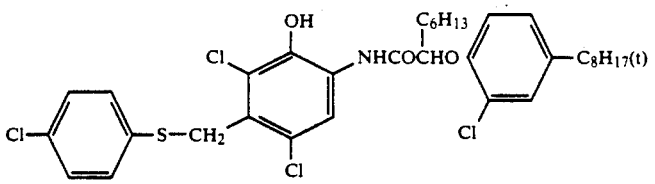
(II-28)
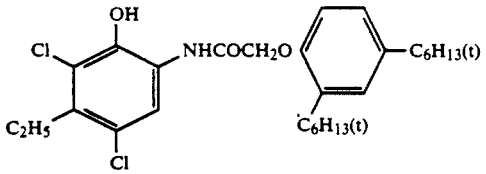
(II-29)
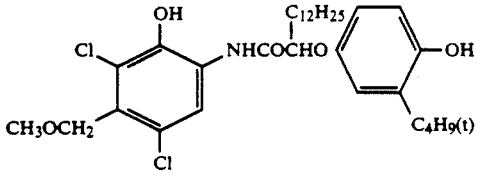
(II-30)
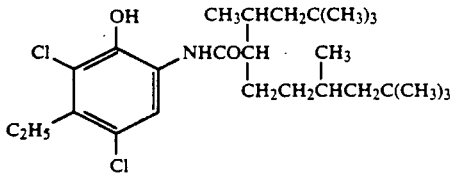

-continued
(II-31)
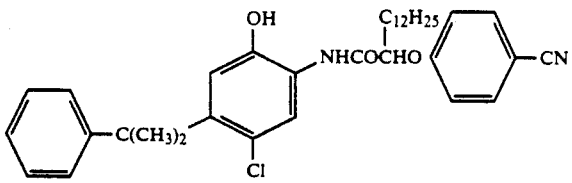
(II-32)
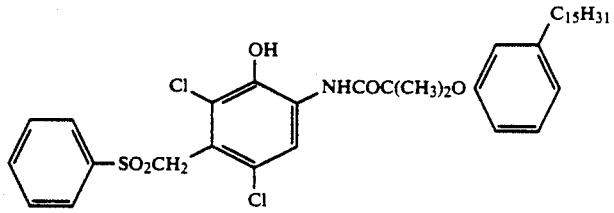
(II-33)
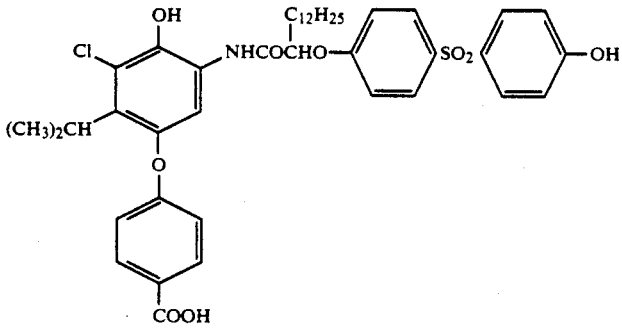
(II-34)
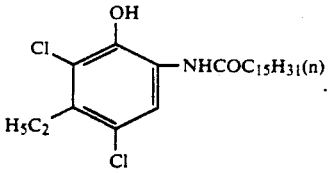
(II-35)
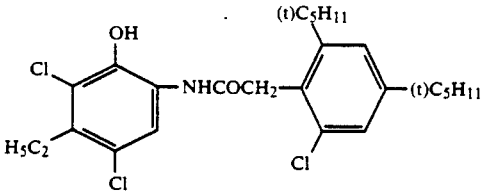
(III-1)
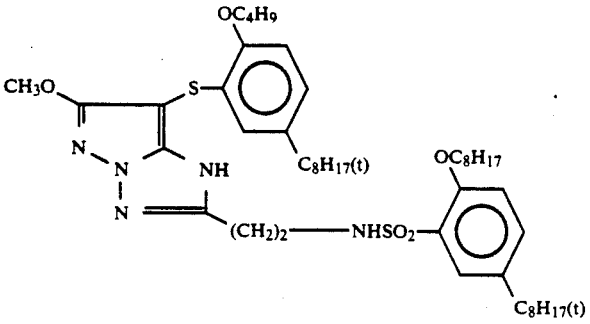
(III-2)
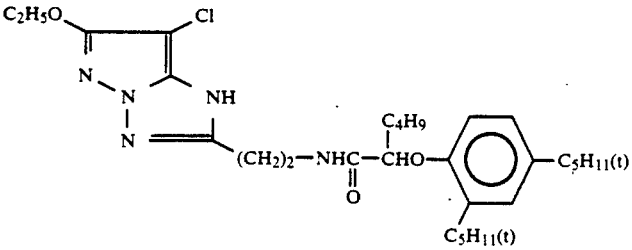

-continued
(III-3)
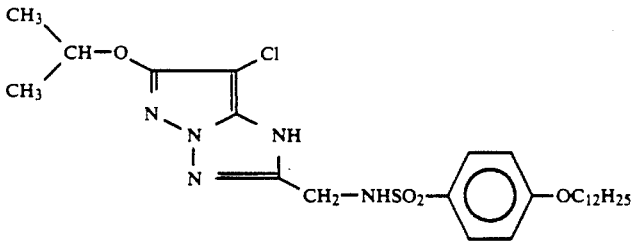
(III-4)
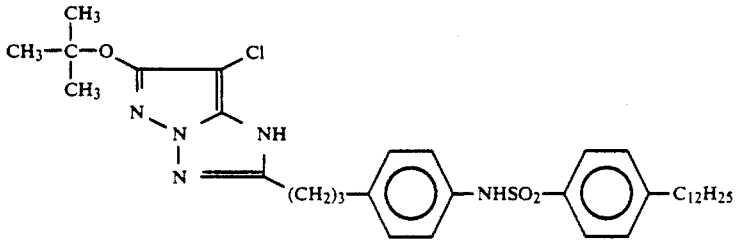
(III-5)
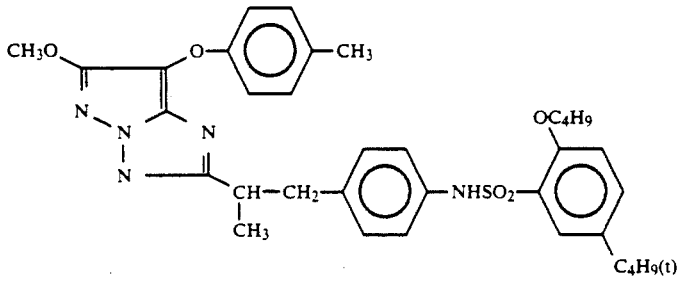
(III-6)
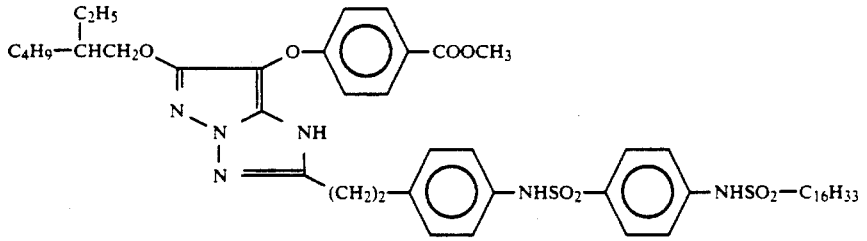
(III-7)
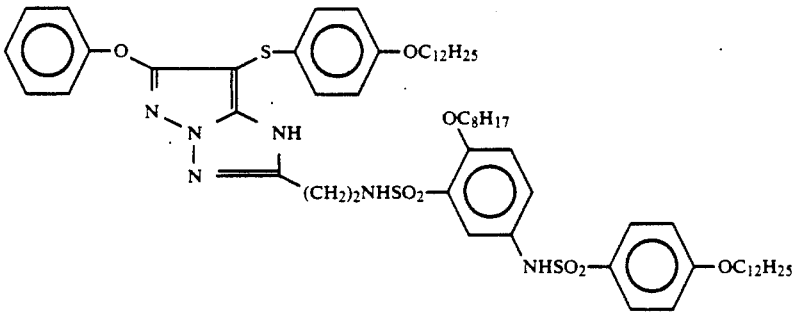
(III-8)
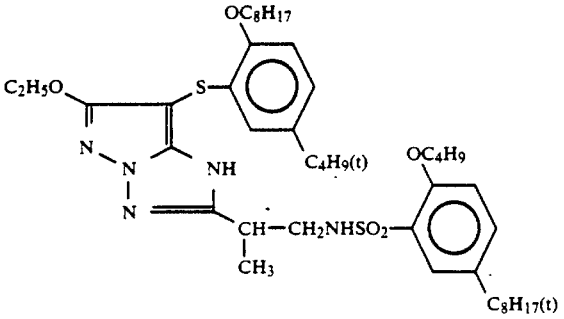

-continued
(III-9)
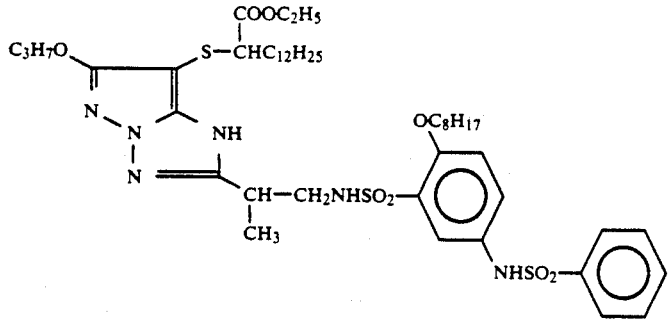
(III-10)
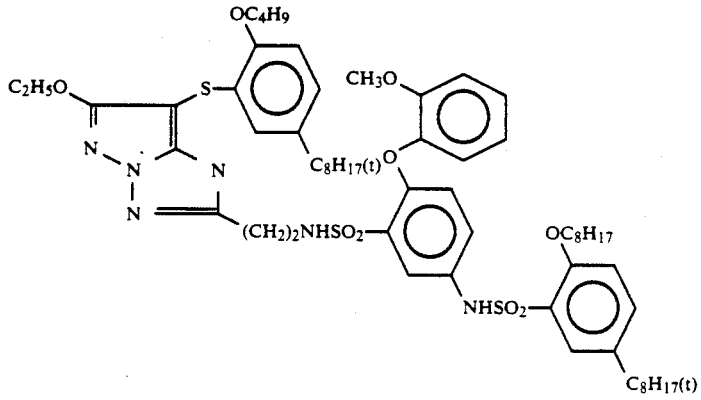
(III-11)
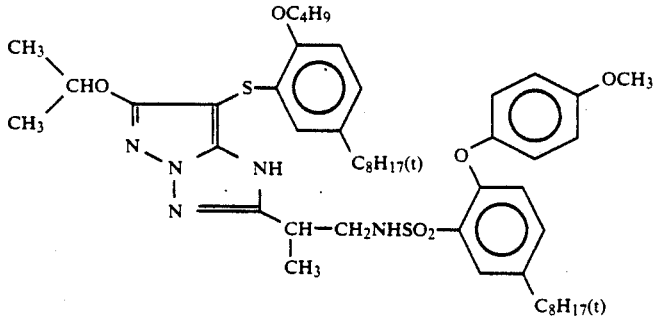
(III-12)
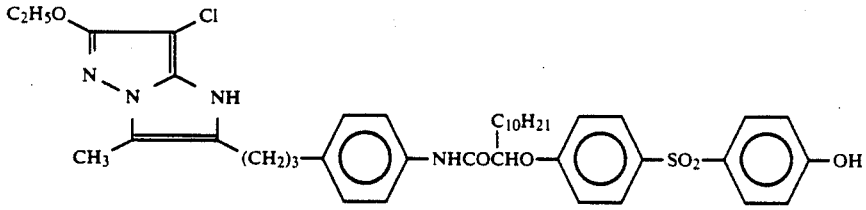
(III-13)
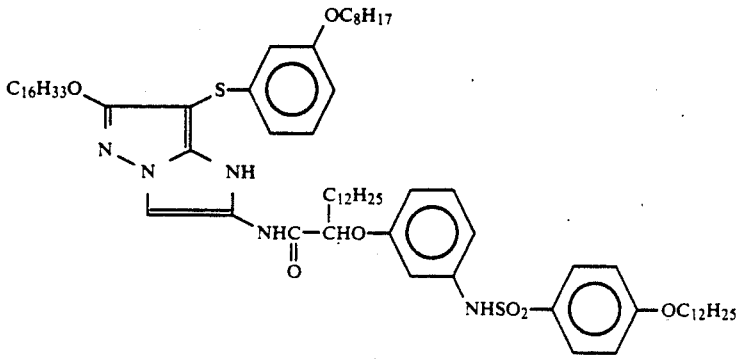

-continued
(III-14)
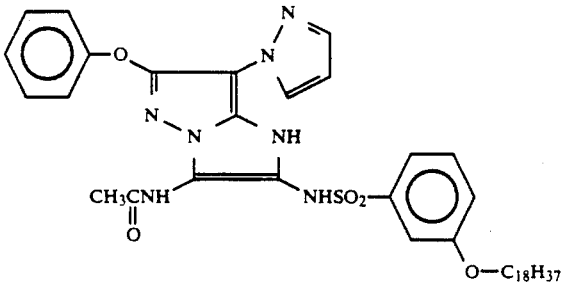
(III-15)
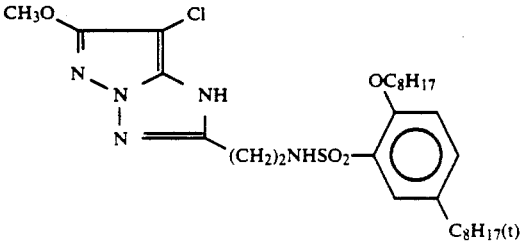
(III-16)
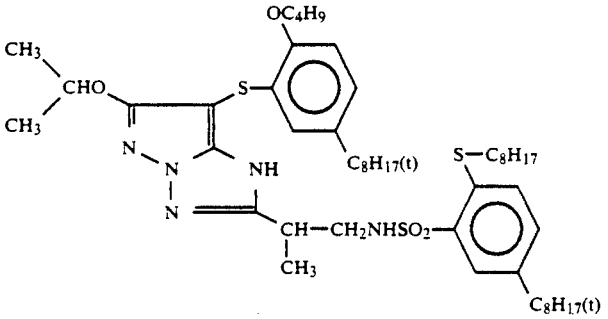
(III-17)
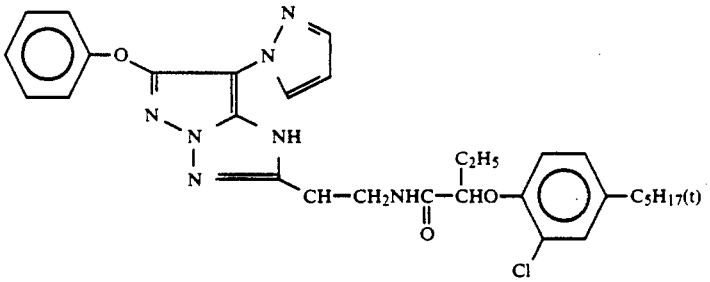
(III-18)
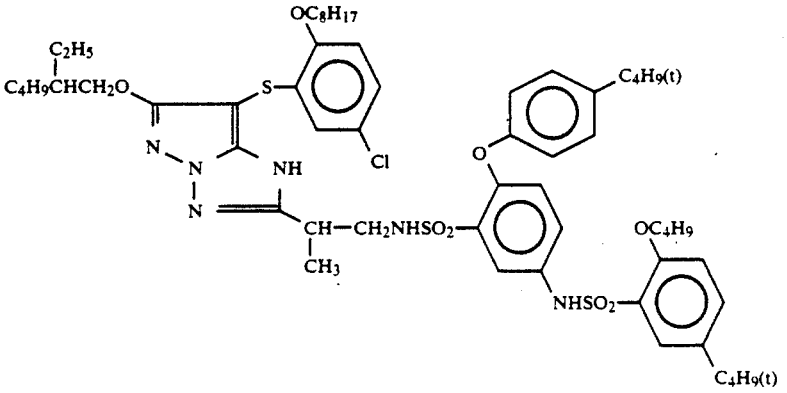

-continued
(III-19)
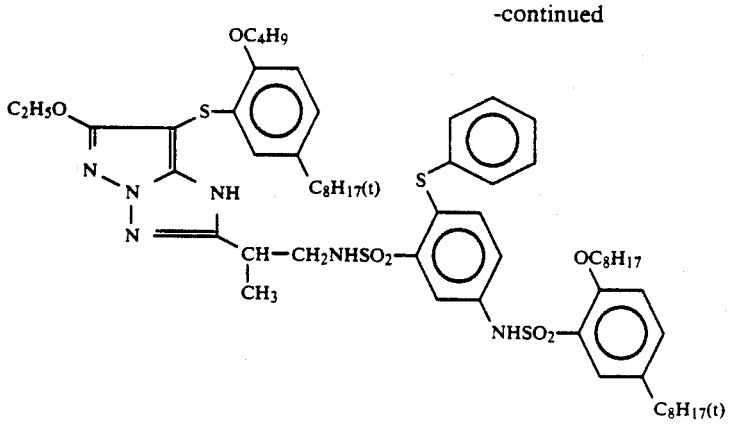
(III-20)
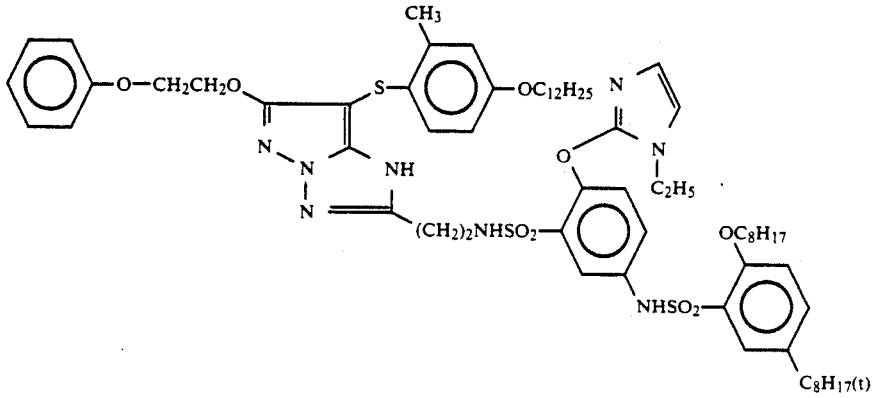
(III-21)
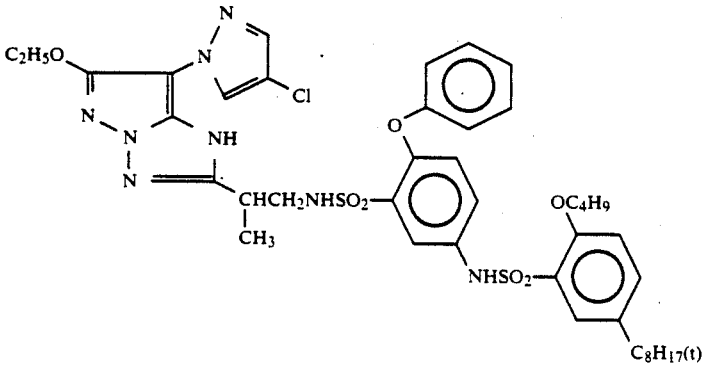
(III-22)
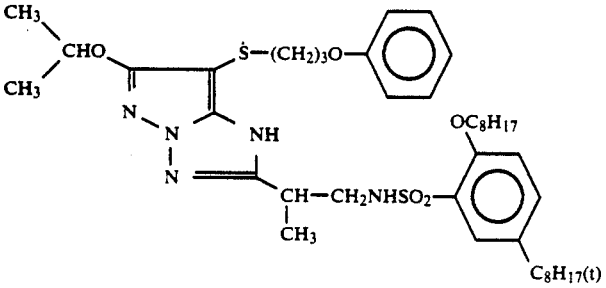
(III-23)
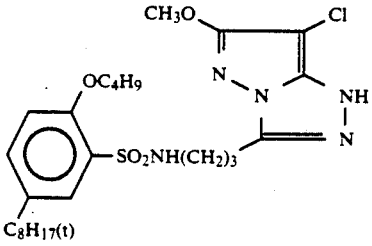

-continued
(III-24)
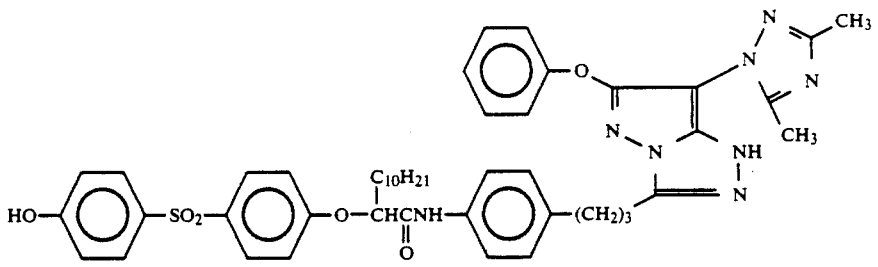
(III-25)
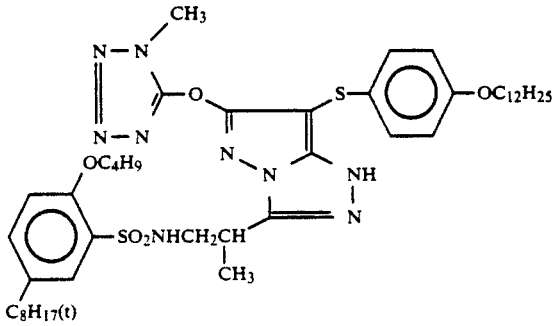
(III-26)
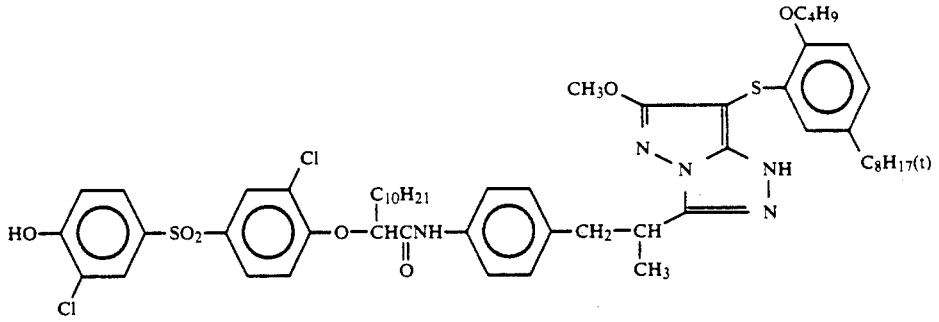
(III-27)
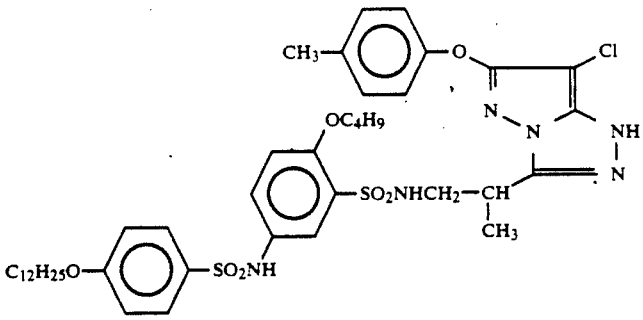
(III-28)
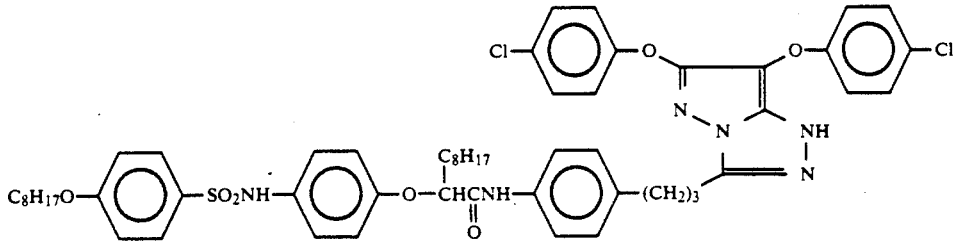

-continued
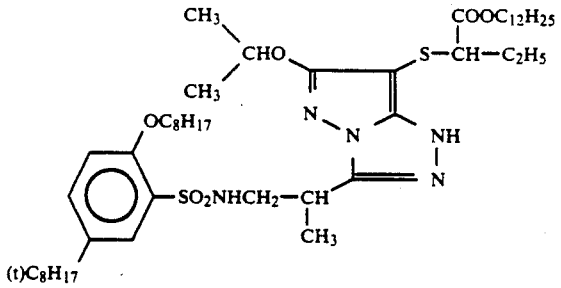
(III-29)
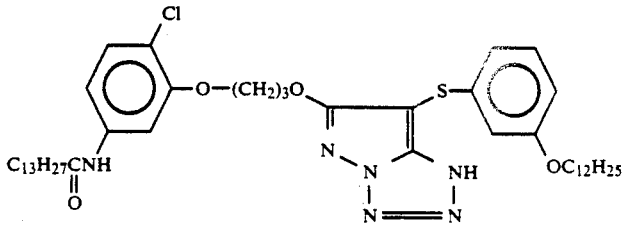
(III-30)
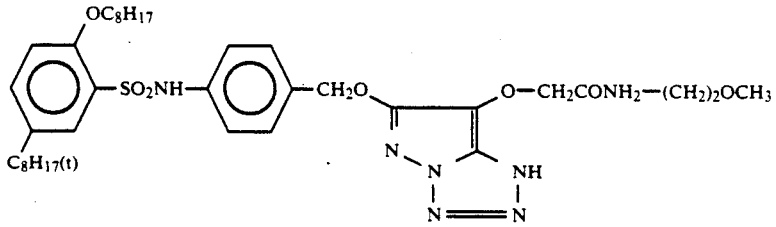
(III-31)
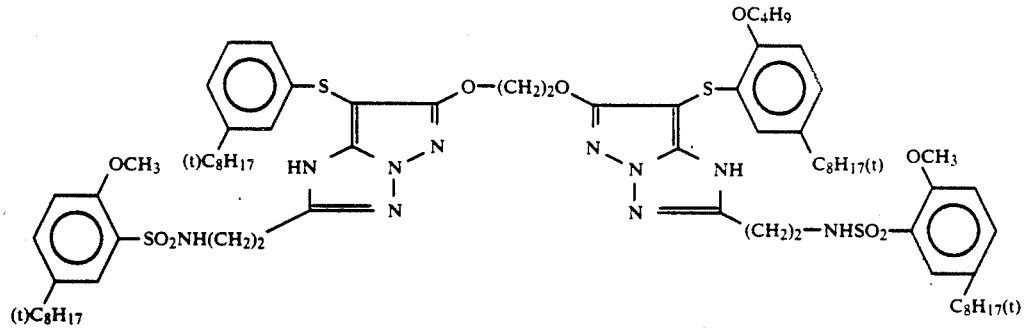
(III-32)
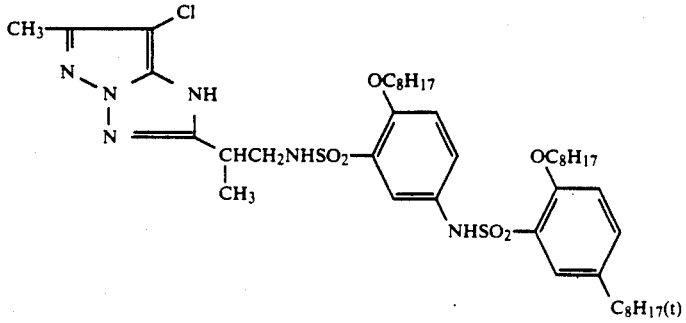
(III-33)

-continued
(III-34)
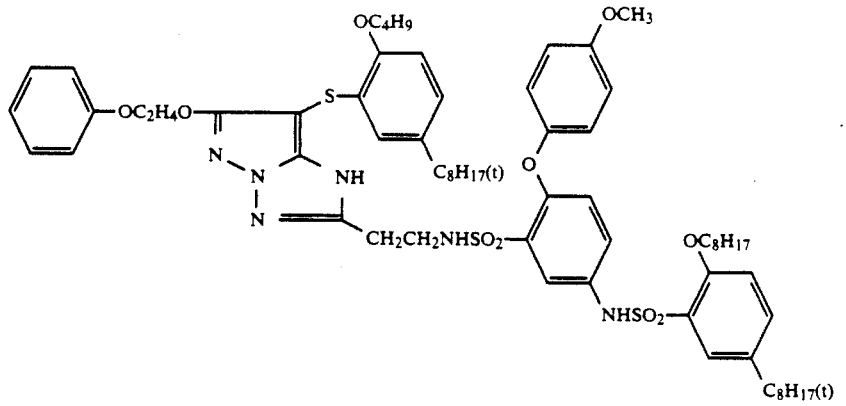
(III-35)
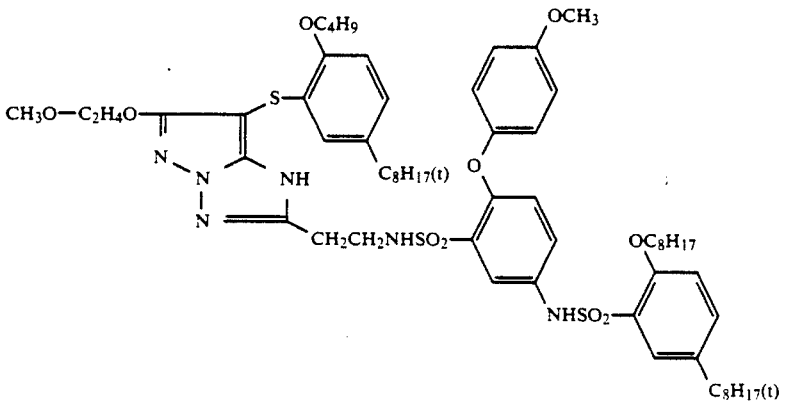
(III-36)
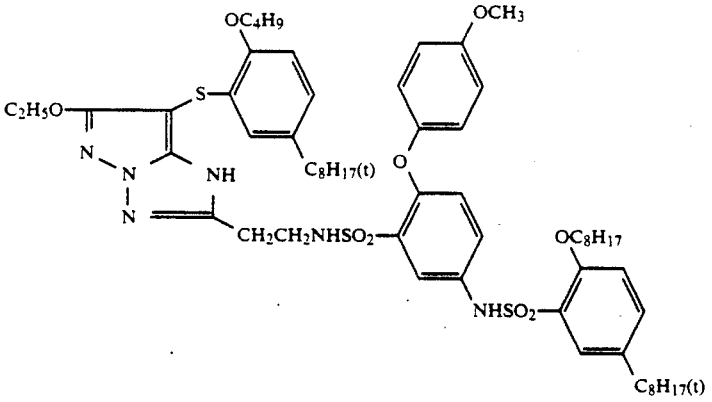
(III-37)
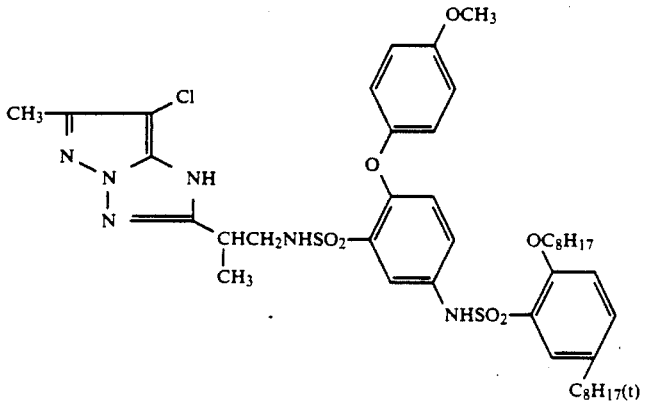

-continued
(III-38)
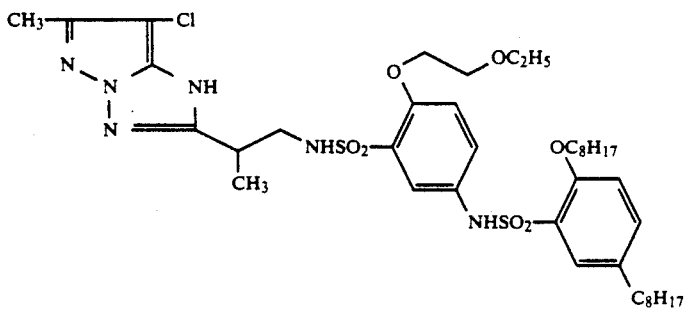
(IV-1)
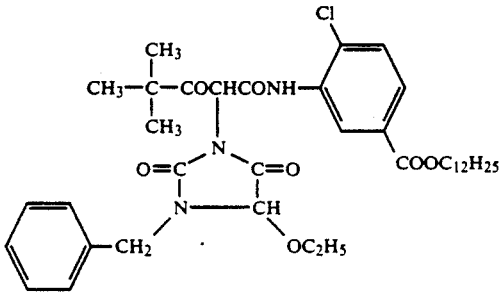
(IV-2)
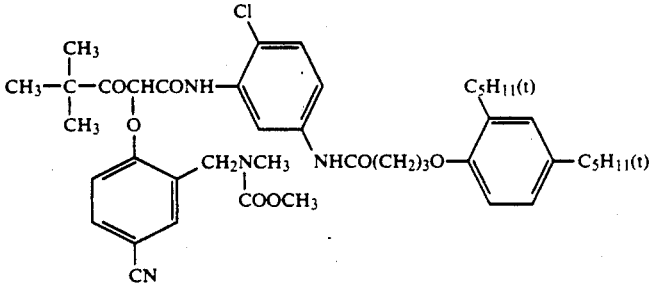
(IV-3)
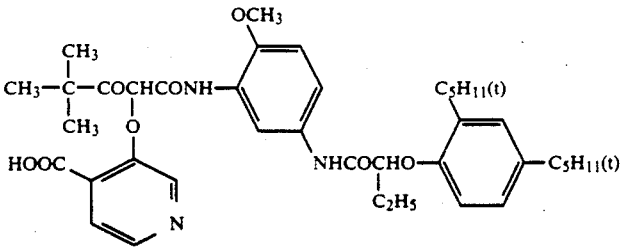
(IV-4)
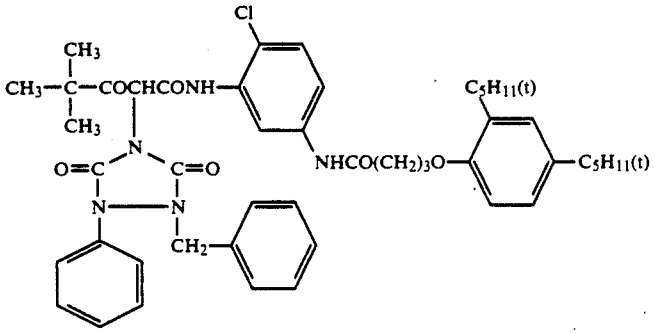

-continued
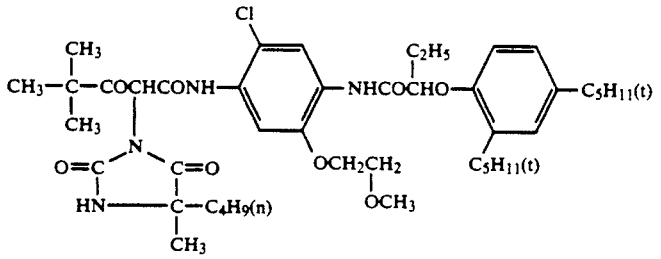
(IV-5)
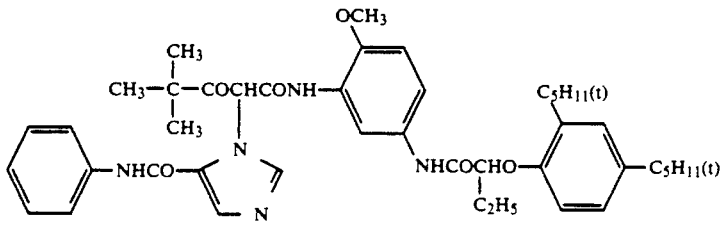
(IV-6)
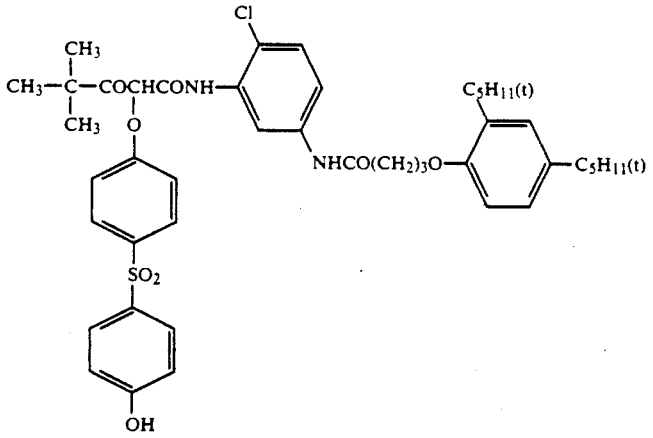
(IV-7)
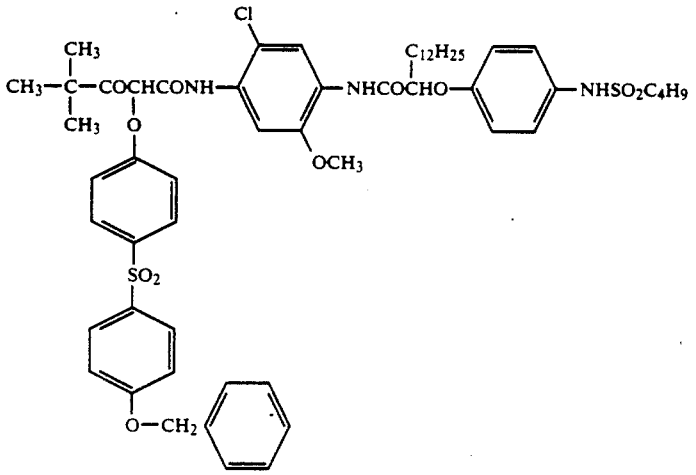
(IV-8)

-continued
(IV-9)
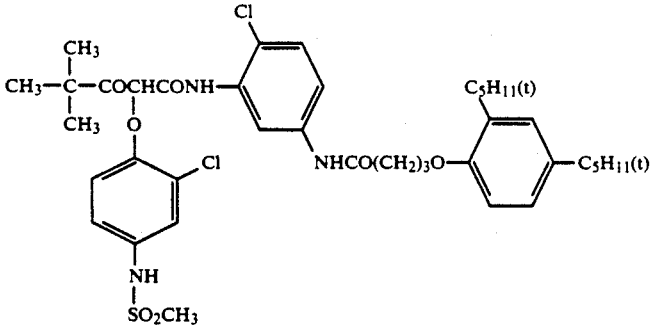
(IV-10)
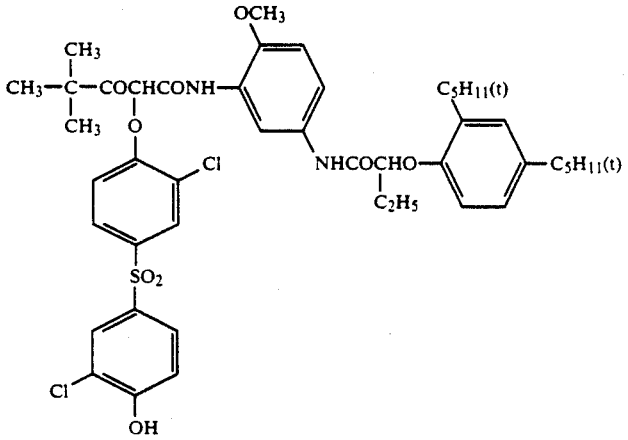
(IV-11)
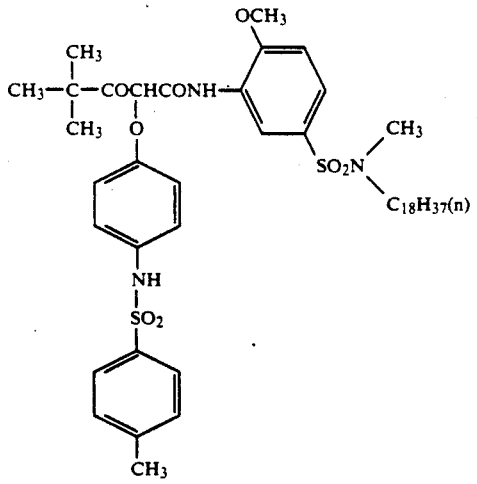
(IV-12)
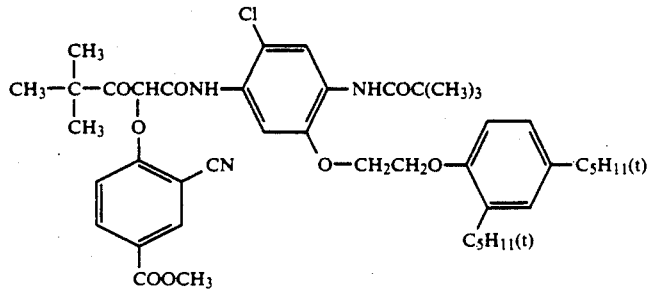

-continued
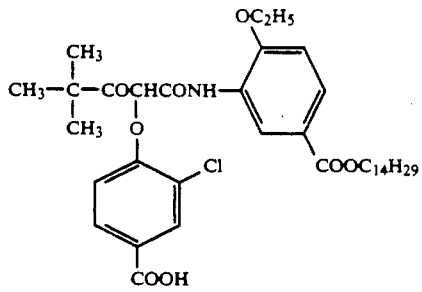
(IV-13)
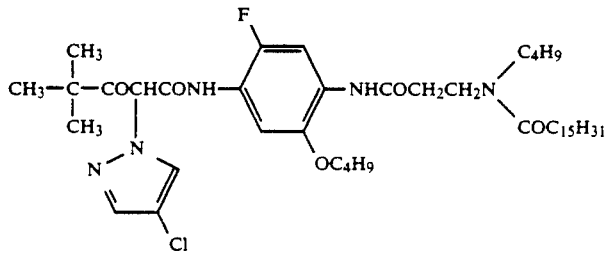
(IV-14)
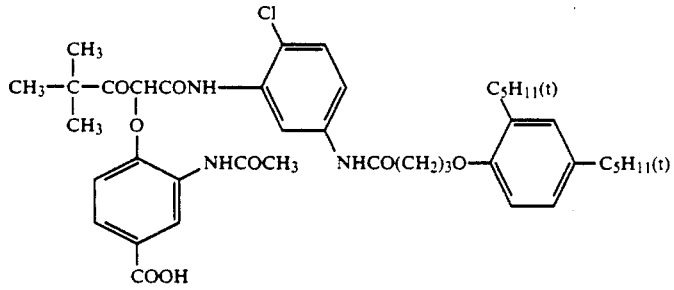
(IV-15)
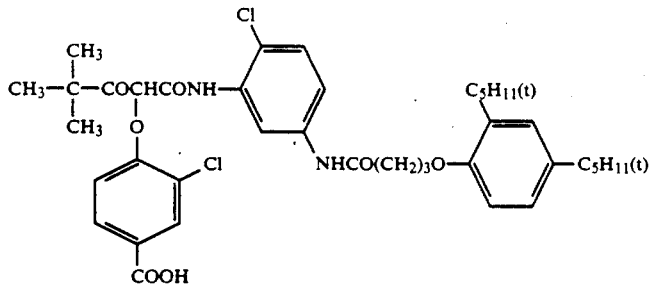
(IV-16)
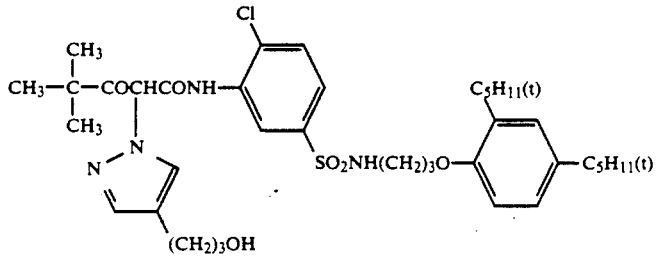
(IV-17)

-continued
(IV-18)
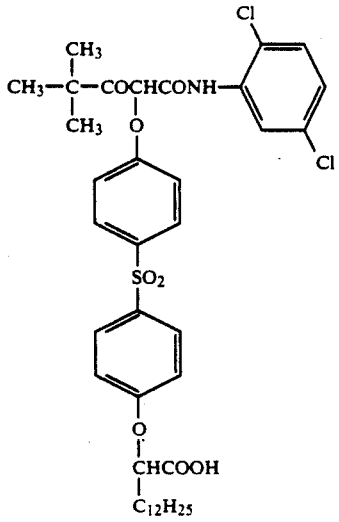
(IV-15)
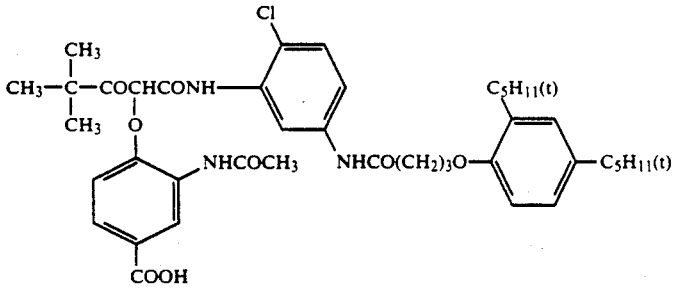
(IV-16)
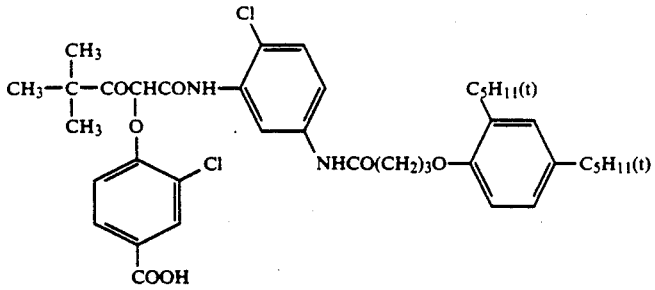
(IV-17)
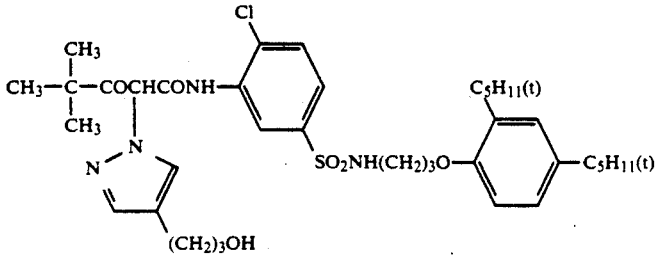

-continued
(IV-18)
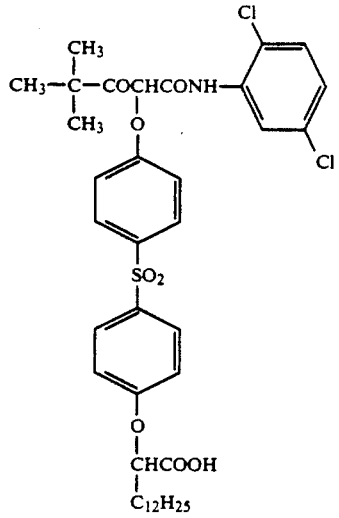
(IV-19)
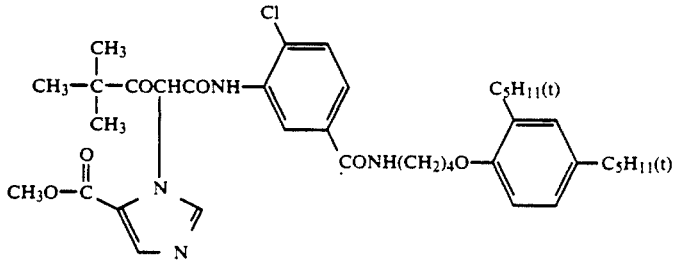
(IV-20)
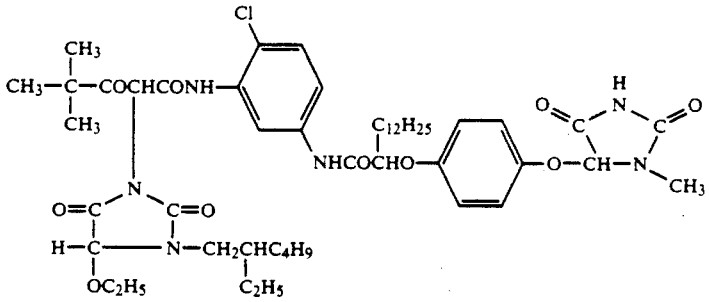
(IV-21)
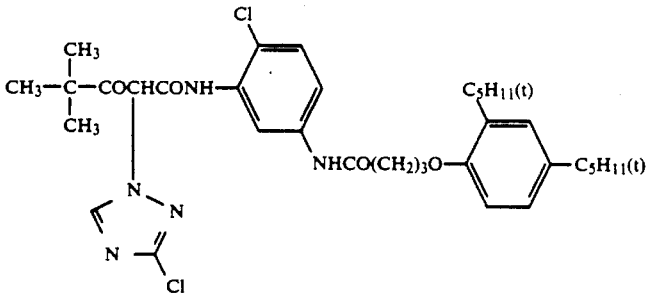
(IV-22)
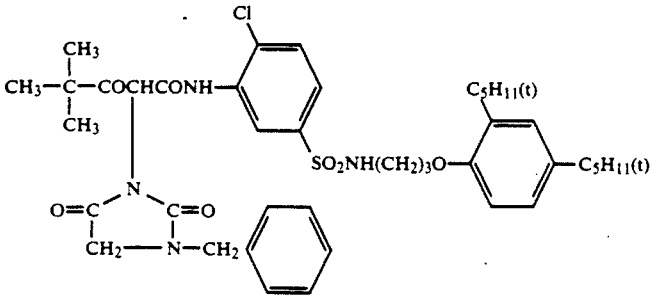

-continued
(IV-23)
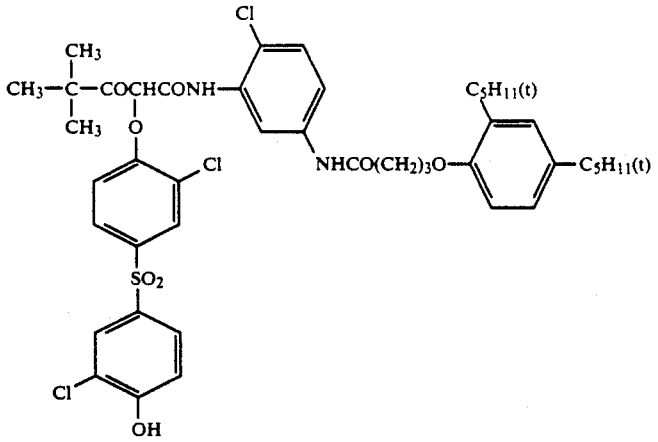
(IV-24)
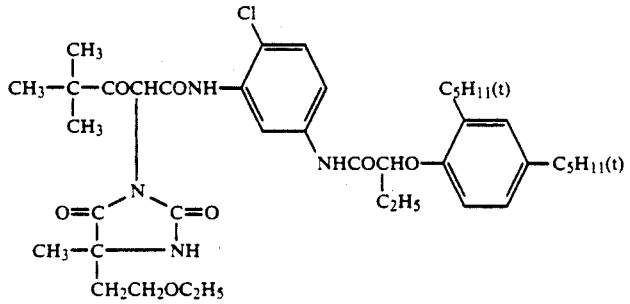
(IV-25)
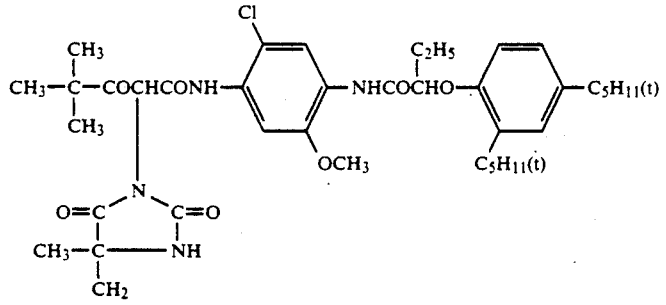
(IV-26)
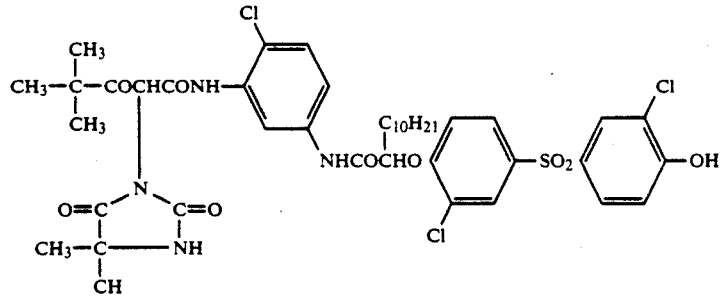
(IV-27)
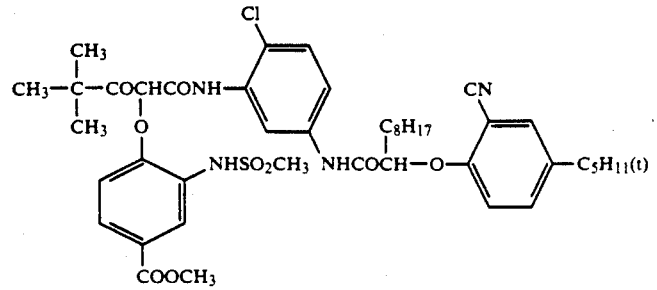

-continued
(IV-28)
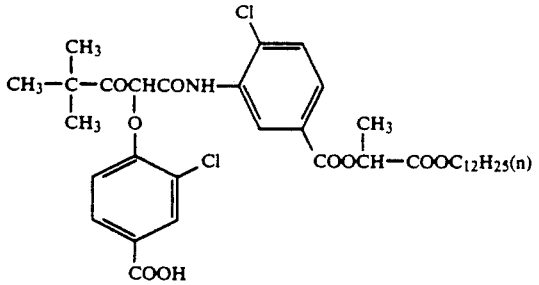
(IV-29)
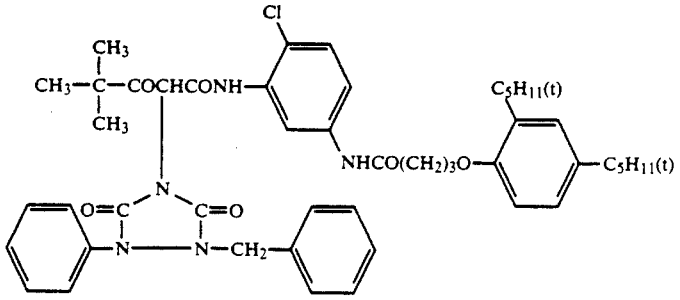
(IV-30)
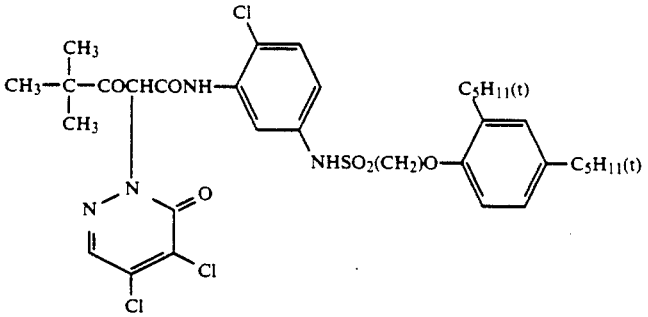
(IV-31)
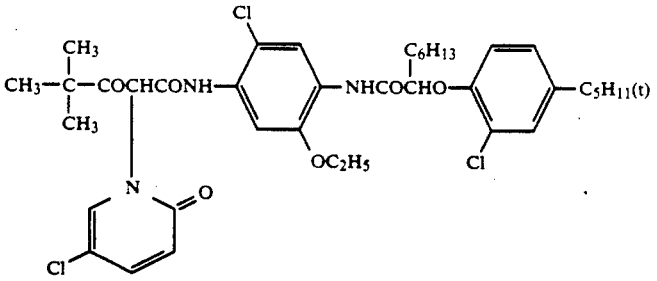
(IV-32)
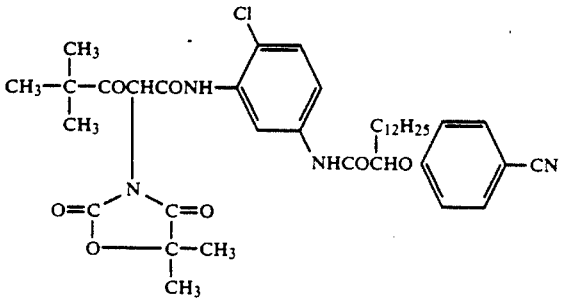

-continued
(IV-33)
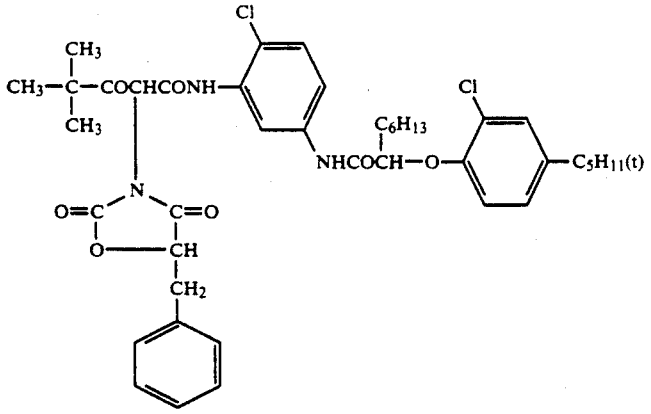
(IV-34)
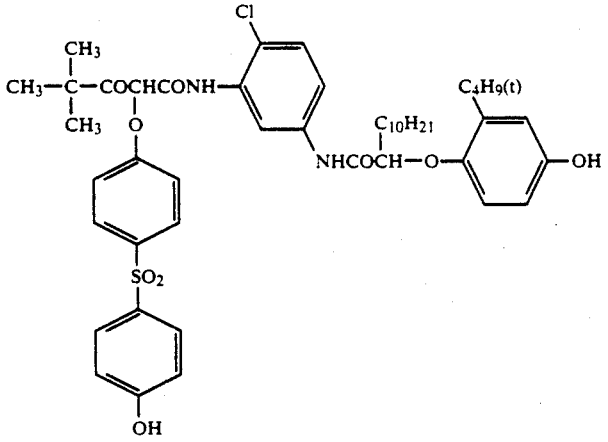
(IV-35)
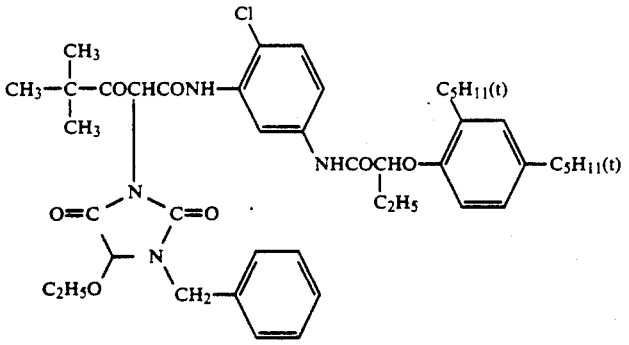
(IV-36)
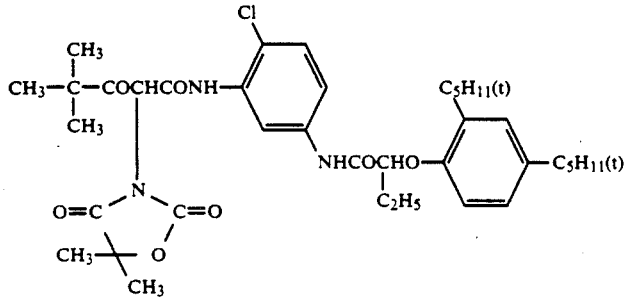

-continued (IV-37)

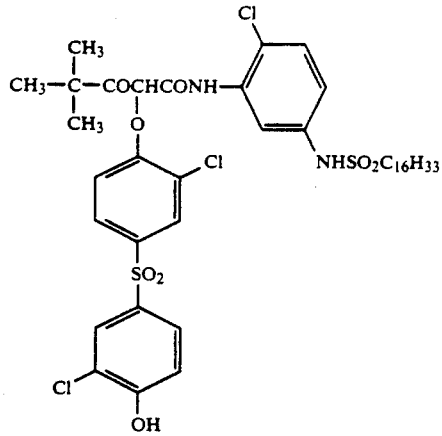

(IV-38)

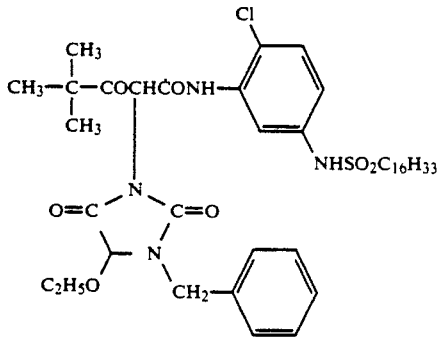

(IV-39)

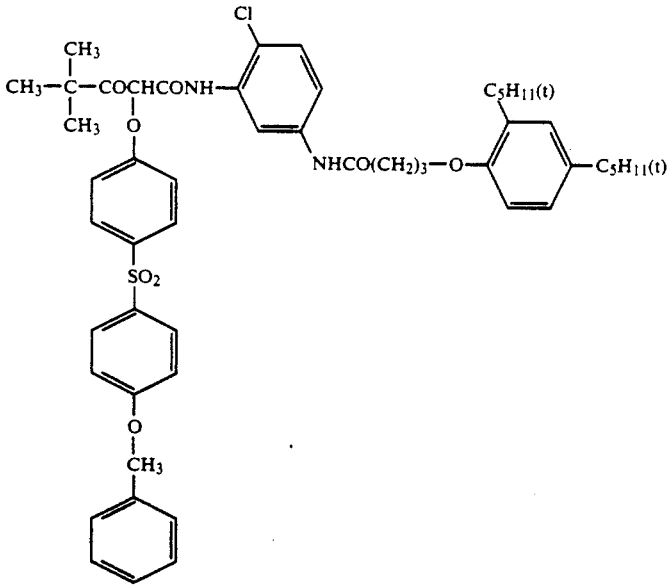

A coupler represented by the general formula (I), (II), (III), or (IV) is contained in each silver halide emulsion layer which composes a photosensitive layer ordinarily in an amount of 0.1 to 1.0 mole, preferably 0.1 to 0.5 mole per 1 mole of silver halide. The ratio of amounts of couplers represented by the general formula (I) or (II), the general formula (III) and the general formula (IV) to be used is ordinarily in a range of about 1:0.2–1.5:0.5–1.5 in molar ratio, but it is possible to use a photosensitive material produced using a ratio beyond the range.

Various known techniques can be applied in the present invention in order to add an aforementioned coupler to the photosensitive layer. The coupler is ordinarily added thereto according to an oil-in-water dispersion method which is known as an oil protect method, and in this instance ordinarily the coupler is dissolved in a solvent and the solution is added to an aqueous gelatin solution containing a surfactant to make an emulsion where the coupler is dispersed. However it is also possible that water or an aqueous gelatin solution was added to a coupler solution containing a surfactant to cause phase immersion and make an oil-in-water dispersion. Further, an alkali soluble coupler may also be dispersed according to a so-called Fischer dispersion method. It is also possible to mix the coupler dispersion after removal of the low boiling organic solvent therefrom by a method such as distillation, noodle water washing or ultrafiltration with a photographic emulsion.

A high boiling organic solvent and/or a water insoluble high molecular compound each having a dielectric constant of 2 to 20 (25° C.) and a refractive index of 1.3 to 1.7 (25° C.) is used as a dispersion medium of such a coupler. In proportion as the dielectric constant or the refractive index becomes larger, the spectral absorption peak wave length of the colored dye becomes longer. As the high boiling organic solvent, an organic solvent having a boiling point of 160° C. or more such as an alkyl phthalate (for example, dibutyl phthalate or dioctyl phthalate), a phophoric ester (for example, diphenyl phosphate, triphenyl phosphate, tricresyl phosphate or dioctyl butyl phosphate), a citric ester (for example, tributyl acetylcitrate), or benzoic ester (for example, octyl benzoate), an alkylamide (for example, diethyllaurylamide), an aliphatic ester (for example, dibutoxyethyl succinate or dioctyl azelate), or a phenol (for example, 2,4-di(t)-aminophenol) may be mentioned. As the water insoluble high molecular compound, a compound among those disclosed in the columns 18 to 21 of Japanese Published Examined Patent Application (hereinafter referred to as "J.P. KOKOKU") No.60-18978, a vinyl polymer (including both a homopolymer and a copolymer) wherein an acrylamide or a methacrylamide is used as a monomer component, or the like may be mentioned.

More specifically, polymethyl methacrylate, polyethyl methacrylate, polybutyl methacrylate, polycyclohexyl methacrylate, poly-t-butylacrylamide or the like is mentioned. Further, together with these high boiling organic solvents and/or water insoluble high molecular compounds, low boiling organic solvents each having a boiling point of 30° to 150° C. such as a lower alkyl acetate (e.g. ethyl acetate or butyl acetate), ethyl propionate, sec-butyl alcohol, methyl isobutyl ketone, β-ethoxyethyl acetate, and methyl cellosolve acetate may be used alone or in combination as occasion demands.

Molecular weight or polymerization degree of the high molecular compound to be used in the present invention does not substantially much influence the effects of the present invention. However, in proportion as the molecular weight of the high molecular compound becomes larger, it takes more time to dissolve it in an auxiliary solvent and the emulsification and dispersion become harder owing to the high viscosity of the solution, whereby coarce grains are formed. As the result, such a problem is liable to occur that the coloring property of the colored dye is lowered or the coating property of the silver halide emulsion becomes worse. However, it causes new problems on process if a large amount of an auxiliary solvent is used as a counterplan therefore to lower the viscosity of the solution. From the above viewpoint, as for the viscosity of the high molecular compound, the viscosity when 30 g of the high molecular compound is dissolved in 100 cc of an auxiliary solvent to be used is preferably 5000 cps or less, further preferably 2000 cps or less. The molecular weight of a high molecular compound usable in the present invention is preferably 150,000 or less, further preferably 80,000 or less, particularly 30,000 or less.

The ratio of a high molecular compound to be used in the present invention to an auxiliary solvent is changed depending on the kind of high molecular compound to be used, its solubility in the auxiliary solvent, its polymerization degree, solubility of the coupler or the like. It is necessary in general that a solution obtained by dissolving two or three of a coupler, a high boiling organic solvent (a solvent of the coupler) and a high molecular compound in an auxiliary solvent has a viscosity so low that when the solution is added to water or an aqueous hydrophilic colloidal solution, followed by mixing, the solute in the forma solution may easily be dispersed in the mixture. An amount of the auxiliary solvent to be used is determined from such a viewpoint. On the other hand, since in proportion as the polymerization degree of the high molecular compound is made to be higher, the viscosity of the solution becomes higher, it is difficult to uniformly determine a ratio of the high molecular compound to the auxiliary solvent regardless of the kind of high molecular compound. However, the range of about 1:1 to 1:50 (weight ratio) is preferable in general. The ratio (weight ratio) of a high molecular compound to be used in the present invention to the coupler is preferably 1:20 to 20:1, further preferably 1:10 to 10:1.

It is possible to select two or more kinds of couplers from the coupler groups of the same hue represented by the general formula (I) or (II), or the general formulae (III) and (IV), and use them together. In this occasion, the couplers may be co-emulsified, or each coupler may separately be emulsified, followed by mixing. Further, it is also possible to use the coupler together with a hereinafter-described fading inhibitor.

Special couplers other than the couplers of the present invention represented by the afore-mentioned general formulae can be contained in the photosensitive material of the present invention, as occasion demands. For example, it is possible to give a masking effect by incorporating a colored magenta coupler in the green sensitive emulsion layer. It is also possible to co-exist a development inhibitor-releasing coupler (DIR coupler), a development inhibitor-releasing hydroquinone or the like in an emulsion layer of each color sensitivity or in a layer adjacent thereto. The development inhibitor released from the compound during development brings about interlayer effect(s) such as improvement of the sharpness of the image, fine granulation of the image and/or improvement of the monochromatic saturation. It is also possible to obtain such effect(s) as improvement of the photographic sensitivity, improvement of the graininess of the color image and/or contrast development of the gradation by adding a coupler which releases a development accelerator or a nucleating agent during the silver development to the photographic emulsion layer(s) or adjacent layer(s) thereof of the present invention.

An ultraviolet absorber can be added to any layer in the present invention. Preferably, the ultraviolet absorber is contained in a layer containing a compound represented by the general formula (I) or (II) or a layer adjacent thereto. Ultraviolet absorbers usable in the present invention are compounds enumerated in the item C of VIII in Research Disclosure No.17643, and preferably benzotriazole derivatives represented by the following general formula (XII).

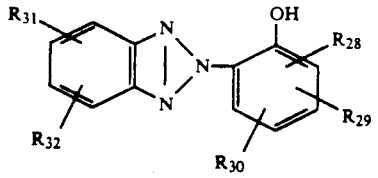

(XVII)

wherein $R_{28}$, $R_{29}$, $R_{30}$, $R_{31}$ and $R_{32}$ may be the same or different, and are hydrogen atoms or aromatic groups which may be substituted with a substituent permitted for $R_1$, and $R_{31}$ and $R_{32}$ may combine to form a 5- or 6-membered aromatic ring composed of carbon atoms. Groups capable of having a substituent among these groups may further respectively be substituted by a substituent permitted for $R_1$.

Compounds represented by the above general formula (XVII) may be used alone or in combination.

Methods for synthesis of the compounds represented by the above general formula (XVII) or examples of other ultraviolet absorbers are disclosed in J.P. KOKOKU No.44-29620, Japanese Published Unexamined Patent Application (hereinafter referred to as "J.P. KOKAI") Nos.50-151149 and 54-95233, U.S. Pat. No. 3,766,205, EP0057160, Research Disclosure No.22519 (1983, No.225) and the like. Further, it is also possible to use ultraviolet absorbers of high molecular weights disclosed in J.P. KOKAI Nos.58-11942, 57-61937, 57-63602, 57-129780 and 57-133371. It is also possible to use a low molecular ultraviolet absorber and a high molecular one together.

The above ultraviolet absorber is dissolved in a high boiling organic solvent, a low boiling organic solvent or a mixed solvent thereof, and dispersed in a hydrophilic colloid. Though there is no special limitation about amounts of the high boiling organic solvent and ultraviolet absorber to be used, it is preferable to use the high boiling organic solvent in an amount of 0 to 300% based on the weight of the ultraviolet absorber. Use of the compounds alone or in combination which are liquid at ordinary temperature is preferable.

It is possible to improve the preservability, above all light fastness of the image of a colored dye, especially a cyan image by using an ultraviolet absorber of the aforementioned general formula (XVII) together with a combination of couplers of the present invention. This ultraviolet absorber and the cyan coupler may be co-emulsified.

It is adequate that the amount of the ultraviolet absorber to be coated is an amount enough to give the cyan dye image light stability, and when a too much amount of the ultraviolet absorber is used, the non-exposed area (white matrix area) of the color photographic photosensitive material sometimes turns yellow. From the foregoing, the amount of the ultraviolet absorber to be coated is usually seleced from a range of $1\times10^{-4}$ to $2\times10^{-3}$ mole/m$^2$, above all $5\times10^{-4}$ to $1.5\times10^{-3}$ mole/m$^2$.

In a construction of the photosensitive material layers of an ordinal color paper, the ultraviolet absorber is contained in at least one, preferably both of the two layers adjacent to the cyan coupler-containing red sensitive emulsion layer. When the ultraviolet absorber is added to the intermediate layer between the green sensitive layer and red sensitive layer, the absorber may be co-emulsified with a color mixing inhibitor. When the ultraviolet absorber is added to the protective layer, another protective layer may be set up by coating as the most outside layer. It is possible to incorporate a matting agent or the like of any grain size in this protective layer.

It is possible to use various organic series and metal complex series of fading inhibitors together in order to enhance the preservability of the colored dye images, particularly yellow and magenta images. As organic fading inhibitors, hydroquinones, gallic acid derivatives, p-alkoxyphenols, p-oxyphenols and the like are mentioned, and as for dye image stabilizers, stain inhibitors or antioxidant, patents are cited in items I and J of VII of Research Disclosure No.17643. Further, metal complex series fading inhibitors are disclosed in Research Disclosure No.15162 and the like.

In order to improve the fastness of a yellow image against heat and light, phenols, hydroquinones, hydroxychromans, hydroxycoumaranes, hindered amines, and many compounds which belong to alkyl ether, silyl ether or hydrolyzable precursor derivatives of these compounds may be used. Compounds represented by the following general formula (XVIII) or (XIX) are effective for improving the light fastness and heat fastness of the yellow image obtained from a coupler of the general formula (IV) together.

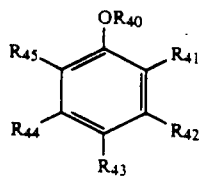

(XVIII)

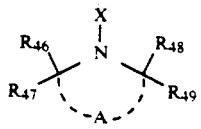

(XIX)

In the above general formula (XVIII) or (XIX), $R_{40}$ represents a hydrogen atom, an aliphatic group, an aromatic group, a heterocyclic group or a substituted silyl group represented by the formula

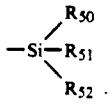

wherein $R_{50}$, $R_{51}$ and $R_{52}$ may be the same or different, and respectively represent aliphatic groups, aromatic groups, aliphatic oxy groups or aromatic oxy groups, and these groups may have a substituent permitted for $R_1$. $R_{41}$, $R_{42}$, $R_{43}$, $R_{44}$ and $R_{45}$ may be the same or different, and respectively represent hydrogen atoms, alkyl groups, aryl groups, alkoxy groups, hydroxyl groups, mono or dialkylamino groups, imino groups or acylamino groups. $R_{46}$, $R_{47}$, $R_{48}$ and $R_{49}$ may be the same or different, and respectively represent hydrogen atoms or alkyl groups. X represents a hydrogen atom, an aliphatic group, an acyl group, an aliphatic or aromatic sulfonyl group, an aliphatic or aromatic sulfinyl group, an oxyradical group or a hydroxyl group. A represents a nonmetal atomic group necessary for forming a 5-, 6- or 7-membered ring.

Methods for synthesizing compounds represented by the general formula (XVIII). or (XIX) or examples of other compounds than those above-mentioned are disclosed in U.K. Patent Nos.1,326,889, 1,354,313 and 1,410,846, U.S. Pat. Nos.3,336,135 and 4,268,593, J.P.

KOKOKU Nos.51-1420 and 526623, and J.P. KOKAI Nos.58-114036 and 59-5246.

Two or more of the compounds represented by the general formula (XVIII) or (XIX) may be used together, and the compound may be used in combination with a hitherto known fading inhibitor.

Though the amount of a compound represented by the general formula (XVIII) or (XIX) to be used is varied depending on the kind of a yellow coupler to be used in combination therewith, the desired object can generally be attained by using the former compound is used in the range of 0.5 to 200% by weight, preferably 2 to 150% by weight based on the yellow coupler It is preferable to co-emulsify the compound with a yellow coupler of the general formula (IV)

The afore-mentioned various dye image stabilizers, stain inhibitors or antioxidants are effective even for improvement of the preservability of the magenta-colored dye formed from a coupler of the general formula (III) of the present invention, and compounds represented by the following general formulae (XX), (XXI), (XXII), (XXIII), (XXIV) or (XXV) are particularly preferable as they greatly improve the light fastness.

General formula (XX)

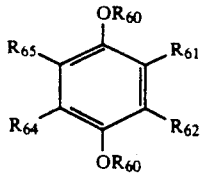

General formula (XXI)

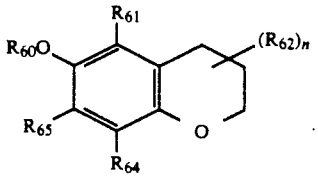

General formula (XXII)

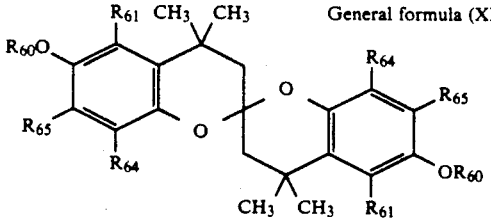

General formula (XXIII)

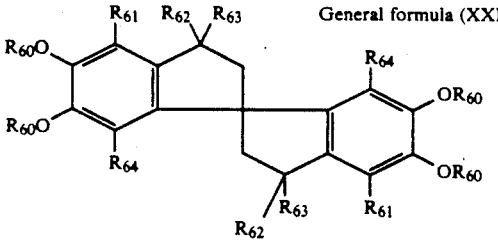

General formula (XXIV)

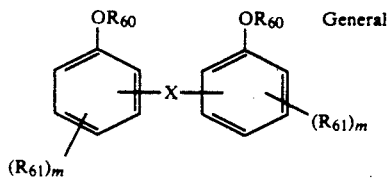

-continued

General formula (XXV)

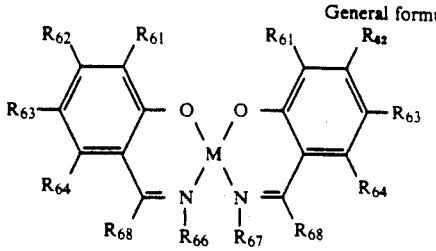

In the above general formula (XX) to (XXV), $R_{60}$ has the same meaning as $R_{40}$ of the general formula (XVIII), and $R_{61}$, $R_{62}$, $R_{64}$ and $R_{65}$ may be the same or different, and respectively represent hydrogen atoms, aliphatic groups, aromatic groups, acylamino groups, mono or dialkylamino groups, aliphatic or aromatic thio groups, acylamino groups, aliphatic or aromatic oxycarbonyl groups or —$OR_{40}$ groups. $R_{40}$ and $R_{61}$ may combine to form a 5- or 6-membered ring. Further $R_{61}$ and $R_{62}$ may combine to form a 5- or 6-membered ring. X represents a bivalent connecting group. $R_{66}$ and $R_{67}$ may be the same or different, and respectively represent hydrogen atoms, aliphatic groups, aromatic groups or hydroxyl groups. $R_{68}$ represents a hydrogen atom, an aliphatic group or an aromatic group. $R_{66}$ and $R_{67}$ may combine to form a 5- or 6-membered ring. M represents Cu, Co, Ni, Pd or Pt. When the substituents $R_{61}$ to $R_{68}$ are aliphatic groups or aromatic groups, they may respectively be substituted by a substituent permitted for $R_1$. n represents 0 or an integer of 1 to 3, and m represents 0 or an integer of 1 to 4. n and m respectively represent substitution numbers of $R_{62}$ and $R_{61}$, and when they are 2 or more, $R_{62}$ or $R_{61}$ groups may respectively be the same or different.

Typical examples of preferred X groups in the general formula (XXIV) include

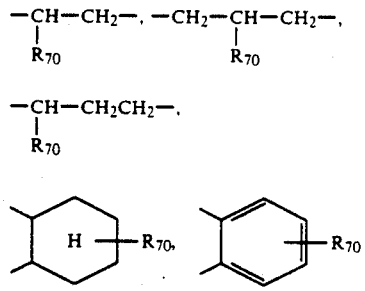

and the like and therein $R_{70}$ represents a hydrogen atom or an alkyl group.

In the general formula (XXV), a preferred $R_{61}$ group is a group capable of forming a hydrogen bond. Such compounds that at least one of the groups represented by $R_{62}$, $R_{63}$ and $R_{64}$ is (are) hydrogen atom(s), hydroxyl group(s), alkyl group(s) or alkoxy group(s) are preferable, and it is preferable that the substituents $R_{61}$ to $R_{68}$ are such substituents that total of the carbon atoms contained therein are respectively 4 or more.

Methods for synthesis of these and other compounds are disclosed in U.S. Pat. Nos. 3,336,135, 3,432,300, 3,573,050, 3,574,627, 3,700,455, 3,764,337, 3,935,016, 3,982,944, 4,254,216 and 4,279,990, U.K. Patent Nos.1,347,556, 2,062,888, 2,066,975 and 2,077,455, J.P. KOKAI Nos.60-97353, 52-152225, 53-17729, 53-20327, 54-145530, 55-6321, 55-21004, 58-24141 and 59-10539, and J.P. KOKOKU Nos.48-31625 and 54-12337.

Each of the compounds represented by the general formulae (XX) to (XXIV) among fading inhibitors advantageously used in the present invention is added in the ratio of 10 to 200 mole %, preferably 30 to 100 mole % based on a magenta coupler used in the present invention. On the other hand, a compound respresented by the general formula (XXV) is added in the ratio of 1 to 100 mole %, preferably 5 to 40 mole % based on a magenta coupler used in the present invention These compounds are preferably respectively co-emulsified with the magenta coupler.

Techniques for decoloration inhibition where the dye image is enclosed with an oxygen barrier composed of a susbtance having a low oxygen transmission factor are disclosed in J.P. KOKAI Nos.49-11330 and 50-57223 Further, it is disclosed in J.P. KOKAI No.56-85747 that a layer having an oxygen transmission factor of 20 $ml/m^2.hr$ atom or less is provided on the support side of a dye image-forming layer of a color photographic photosensitive material. These techniques may be applied to the present invention.

Various silver halides may be used in the silver halide emulsion layers of the present invention. Such silver halides include, for exmaple, silver chloride, silver bromide, silver chlorobromide, silver iodobromide and silver bromochloroiodide.

The halogen composition of the silver halide may freely be chosen according to object without specific limitation. Silver chlorobromide having a silver bromide content of 10 mole % or less is especially preferable for rapid processing of a color paper.

There is no restriction about the crystal shape, crystal structure, grain size, grain size distribution and the like of silver halide grains. However, it is preferable to use monodispersed silver halide emulsions containing silver halide grains having a coefficient of variation of 0.15 or less, preferably 0.10 or less. The crystals of silver halide may be regular crystals or twined crystals, and may also be any of hexahedron, octahedron or tetradecahedron. Further, the crystals may be tabular grains which have thicknesses of 0.5 μm or less, sizes of at least 0.6 μm and an average aspect ratio of 5 or more. Preferably, silver halide grains contained in at least one of silver halide emulsion layers are mainly regular crystals of cubic or tetradecahedral form.

The crystal structure may be uniform or has a composition different in the inside and outside, may also be a layer structure, may be a structure wherein silver halides having different compositions are conjugated by epitaxial conjunction, or may be composed of the mixing of grains of various crystal shapes. Further, the silver halide grains may be those which form latent images mainly on the grain surfaces, or those which form them mainly inside the grains.

The silver halides may be fine grains each having a grain size of 0.1 μm or less, or large-sized grains each having a diameter of the projected surface area reaching to 3 μm. The silver halide emulsion may be a monodispersed emulsion having a narrow distribution or a multi-dispersed emulsion having a wide distribution.

These silver halide grains may be prepared according to known methods which have usually been used in the art.

The aforesaid silver halide emulsion may be sensitized by a usual chemical sensitization, namely sulfur sensitization, noble metal sensitization or combination thereof.

Either a transparent support such as polyethylene terephthalate or cellulose triacetate or a reflecting support described below may be used as a support in the present invention. Preferred support is a reflecting support, examples of which include a baryta paper, a polyethylene-coated paper, a polypropylene series synthetic paper, and a transparent support such as a glass plate, a polyester film (e.g., a polyethylene terephthalate, cellulose triacetate or cellulose nitrate film), a polyamide film, a polycarbonate film or a polystyrene film which transparent support is provided thereon a reflecting layer or used in combination with a reflecting material. A support to be specifically used is appropriately selected from these supports based on the purpose of use.

Blue sensitive, green sensitive and red sensitive emulsions of the present invention are emulsions spectrally sensitized so as to have respective color sensitivities with methine dyes or the like. Examples of dyes to be used include cyanine dyes, merocyanine dyes, complex cyanine dyes, complex merocyanine dyes, holopolar cyanine dyes, hemicyanine dyes, styryl dyes and hemioxonol dyes. Especially useful dyes are cyanine dyes, merocyanine dyes and complex merocyanine dyes. Any nucleus usually utilized in a cyanine dye as a basic heterocyclic nucleus is applicable to these dyes. That is to say, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus or the like; or a nucleus where an alicyclic hydrocarbon ring or an aromatic hydrocarbon ring is fused with one of these nuclei, for example, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus is applicable. These nuclei may respectively have substituent(s) on the carbon atom(s).

A 5- or 6-membered heterocyclic nucleus having a ketomethylene structure such as a pyrazolin-5-one nucleus, a thiohydantoin nucleus, a 2-thiooxazolidin-2,4-dione nucleus, a thiazolidin-2-4-dione nucleus, a rhodanine nucleus or a thiobarbituric acid nucleus is applicable to a merocyanine dye or a complex merocyanine dye.

These sensitizing dyes may be used alone or in combination, and a combination of sensitizing dyes is often used especially for the purpose of supersensitization. Typical examples of such combinations are disclosed in U.S. Pat. Nos.2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, U.K. Patent Nos.1,344,281 and 1,507,803, J.P. KOKOKU Nos.43-4936 and 53-12375, and J.P. KOKAI Nos.52-110618 and 52-109925.

A substance which exhibits supersensitization but which is a dye not having a spectral sensitization effect or a substance not substantially absorbing a visible light, may be contained in the emulsion together with a sensitizing dye.

An auxiliary layer such as an undercoat layer, an intermediate layer or a protective layer may be provided besides the above construction layers in a color photographic photosensitive material of the present invention. Further, the second ultraviolet-absorbing layer may be provided between red sensitive silver halide emulsion layer(s) and green sensitive silver halide emulsion layer(s) as occasion demands. It is preferable to use an afore-mentioned ultraviolet absorber for the second ultraviolet-absorbing layer, but other known ultraviolet absorbers may be used therefor.

Gelatin is advantageously used as a bonding agent or a protective colloid of the photographic emulsion. However, other hydrophilic colloids may be used therefor, and include for example, proteins such as a gelatin derivative, a graft polymer of gelatin and another high molecular compound, albumin and casein; cellulose derivatives such as hydroxyethylcellulose, carboxymethylcellulose and cellulose sulfate ester; sugar derivatives such as sodium alginate and a starch derivative; and various synthetic hydrophilic high molecular substances such as homopolymers or copolymers of polyvinyl alcohol, partly acetalized polyvinyl alcohol, poly-N-vinylpyrrolidone, polyacrylic acid, polymethacrylic acid, polyacrylamide, polivinylimidazole and polivinylpyrazole.

Lime-treated gelatin, acid-treated gelatin or such enzyme-treated gelatin as disclosed in Bull. Soc. Sci. Photo. Japan No.16, 30 (1966) may be used as gelatin, and a hydrolyzate or enzyme-decomposed substances of gelatin may also be used. A brightener belonging to stilbene series, triazine series, oxazole series, coumarin series or the like may be contained in hydrophilic colloidal layers of the photographic emulsion layers or the like in a photosensitive material of the present invention. These brighteners may be water soluble, or a water-insoluble brightener may be used in the form of a dispersion. Specific examples of fluorescent brighteners are disclosed in U.S. Pat. Nos.2,632,701, 3,269,840 and 3,359,102, U.K. Patent Nos.852,075 and 1,319,763, the item of Brighteners at lines 9 to 36, left column in page 24 of Research Disclosure 176, No.17643 (published in December, 1978) and the like.

When a dye, an ultraviolet absorber and the like are contained in the hydrophilic colloidal layer(s) of a photosensitive material of the present invention, they may be mordanted with a cationic polymer or the like. Examples of such cationic polymers are disclosed in U.K. Patent No.685,475, U.S. Pat. Nos. 2,675,316, 2,839,401, 2,882,156, 3,048,487, 3,184,309 and 3,445,231, West Germany Patent Application (OLS) No.1,914,362, J.P. KOKAI Nos.50-41624 and 50-71332, and the like.

The photosensitive material of the present invention may contain a hydroquinone derivative, an aminophenol derivative, a gallic acid derivative, an ascorbic acid derivative or the like as an anticolorfoggant, and examples thereof are disclosed in U.S. Pat. Nos.2,360,290, 2,336,327, 2,403,721, 2,418,613, 2,675,314, 2,701,197, 2,704,713, 2,728,659, 2,732,300 and 2,735,756, J.P. KOKAI Nos.50-92988, 50-92989, 50-93928, 50-110337 and 52-146235, J.P. KOKOKU No.50-23813, and the like.

Various photographic additives other than the abovedescribed additives known in the field, for example, a stabilizer, an antifoggant, a surfactant, a coupler other than those necessitated for the present invention, a filter dye, an irradiation inhibitor and a developing agent may respectively be added to the color photographic photosensitive material of the present invention, as occasion demands.

Further, in some occasions, a fine grain silver halide emulsion having no substantial photosensitivity (for example, a silver chloride, silver bromide or silver chlorobromide emulsion having an average grain size of 0:20 μm or less) may be added to the silver halide emulsion layer(s) or another hydrophilic colloidal layer.

A color developing solution usable in the present invention is an aqueous alkaline solution containing a paraphenylenediamine series color developing agent as a main component. Typical examples of the color developing agents include 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline and the like.

The color developing solution may contain a pH buffer such as a sulfite, carbonate, borate or phosphate of an alkali metal, a development inhibitor or antifoggant such as a bromide, an iodide or an organic antifoggant, and the like. The color developing solution may further contain a water softener, a preservative such as hydroxylamine, a development accelerator such as polyethylene glycol, a quaternary ammonium salt or an amine, a dye-forming coupler, a competing coupler, a fogging agent such as sodium borohydride, an auxiliary developing agent such as 1-phenyl-3-pyrazolidone, a thickner, a polycarboxylic acid series chelating agent disclosed in U.S. Pat. No. 4,083,723, an antioxidant disclosed in OLS No.2,622,950 or the like, as occasion demands.

Though a compound such as benzyl alcohol which promotes color development by promoting the coupling reaction may be contained therein, such a compound that promotes the coupling generally acts so as to make the spectral absorption spectrum of the colored dye broader and make the color reproduction thereof worse, and is not so preferable for the object of the present invention. When used, the preferred amount of benzyl alcohol to be contained is 20 cc or less, particularly 5 cc or less per 1 l of the color developing solution.

The photographic emulsion layer after color development is usually subjected to a bleaching process. The bleaching process may be carried out simultaneously with or independently from a fixing process. Examples of a bleaching agent to be used include a compound of a polyvalent metal such as iron (III), cobalt (III), chromium (VI) or copper (II), a per acid, a quinone, a nitroso compound and the like. More specifically, a ferricyanide; a dichromate; a complex salt of iron (III) or cobalt (III) with an organic acid such as an aminopolycarboxylic acid (e.g.,. ethylenediaminetetraacetic acid, nitrilotriacetic acid or 1,3-diamino-2-propanoltetraacetic acid); citric acid, tartaric acid or malic acid; a persulfate; a permanganate; nitrosophenol or the like may be used as the bleaching agent. Potassium ferricyanide, sodium (ethylenediaminetetraacetato) iron (III) and ammonium (ethylenediaminetetraacetato) iron (III) are particularly useful among them. A (Ethylenediaminetetraacetato) iron (III) complex is useful both in an independent bleaching solution and in a single bath bleach-fixing solution.

Water washing may be carried out after the color developing or bleach-fixing process. Color development may be carried out at any temperature between 18° C. and 55° C., preferably at a temperature of 30° C. or more, particularly 35° C. or more. Generally time to be required for development is about 3.5 minutes or less, and a shorter time is preferable. Supplement of a replenisher is preferable in a continuous developing process, and 330 to 160 cc, preferably 100 cc or less of a replenisher is supplemented per 1 $m^2$ of the area to be processed.

Bleach-fixing may be carried out at any temperature of 18° to 50° C., preferably at a temperature of 30° C. or more. At a temperature of 35° C. or more, it is possible to make the process time one minute or less and make the amount of the replenisher smaller. Time to be required for water washing after the color development or bleach-fixing is usually within 3 minutes, and it is also possible to make the time within one minute by using such a multi-step counterflow stabilization process as disclosed in J.P. KOKAI No.57-8543.

The colored dye deteriorates by light, heat or temperature, and also deteriorates and fades during preservation even by molds. Cyan image greatly deteriorates particularly by molds, and use of an antimold is preferable. Specific examples of the antimolds are such 2-thiazolylbenzimidazoles as disclosed in J.P. KOKAI No.57-157244. The antimold may be contained in the photosensitive material or added from the outside in the development process step, or may further be added in any process step so long as it can be made to exist in the photosensitive material after processes.

The present invention is further explained below by examples, but not limited thereto.

EXAMPLE 1

A color photographic paper wherein layers respectively having compositions shown in the following Table 1 were provided on a paper support, both faces of which had been laminated with polyethylene, was produced. Coating solutions were prepared as follows.

Preparation of the 1st layer coating solution 10 ml of ethyl acetate and 4 ml of the solvent (c) were added to 10 g of yellow coupler (a) and 23 g of dye image stabilizer (b) to make a solution. The solution was emulsified and dispersed in 90 ml of an aqueous 10% gelatin solution containing 5 ml of 10% sodium dodecylbenzenesulfonate. On the other hand, a blue sensitive dye shown below was added to a silver chlorobromide emulsion (ratio of silver bromide 80 mole %, silver content 70 g/kg) in an amount of $4\times10^{-4}$ moles per 1 mole of silver chlorobromide to obtain a blue sensitive emulsion. The emulsified dispersion and the emulsion were mixed to make a solution. The concentration of the solution was adjusted with gelatin so that the solution comes to have a composition shown in Table 1, whereby the lst layer coating solution was prepared.

The silver halide emulsion (1) used in the example of the present invention was prepared in the following manner.

Liquid 1

H2O 1000 ml, NaCl 5.5 g, Gelatin 25 g

Liquid 2

Sulfuric acid (IN) 20 ml

Liquid 3

The following compound (1%) 2 ml

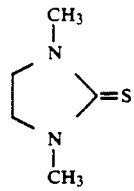

Liquid 4

KBr 2.80 g, NaCl 0.34 g, with addition of water 140 ml

Liquid 5

$AgNO_3$ 5 g, with addition of water 140 ml

Liquid 6

KBr 67.20 g, NaCl 8.26 g, $K_2IrCl_6$(0.001%) 0.7 ml, with addition of water 320 ml Liquid 7

$AgNO_3$ 120 g, $NH_4NO_3$ (50%) 2 ml, with addition of water 320 ml

Liquid 1 was heated to 75° C., and Liquid 2 and Liquid 3 were added thereto. Then, Liquid 4 and Liquid 5 were simultaneously added thereto over a period of 9 minutes. 10 minutes thereafter, Liquid 6 and Liquid 7 were simultaneously added thereto over a period of 45 minutes. 5 minutes thereafter, the temperature of the mixture was lowered to carry out desalting. Water and a dispersed gelatin were added thereto and the pH of the mixture was adjusted to 6.2, whereby a monodispersed cubic silver chlorobromide emulsion of 80 mole % silver bromide having an average grain size of 1.01, μm and a variation coefficient (a value given by dividing standard deviation by the average grain size; S/d) of 0.08. This emulsion was treated with sodium thiosulfate so as to give the optimum chemical sensitizaton.

The silver chlorobromide emulsions (2) and (3) of the green sensitive and red sensitive emulsion layers of the present invention were respectively prepared in the same manner as above-described varying amounts of the chemicals, temperatures and times.

The emulsion (2) was a monodispersed cubic silver chlorobromide of 75 mole % silver bromide having a grain size of 0.45 μm and a variation coefficient of 0.07, and the emulsion (3) was a monodispersed cubic silver chlorobromide of 70 mole % silver bromide having a grain size of 0.5 μm and a variation coefficient of 0.07.

The structures of compounds such as couplers used in this example are as follows:

Magenta coupler

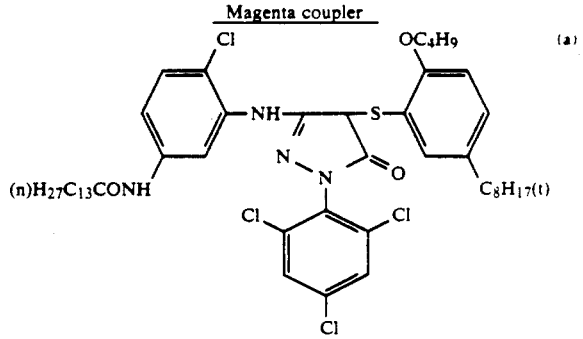

-continued
Dye image stabilizer
(a)
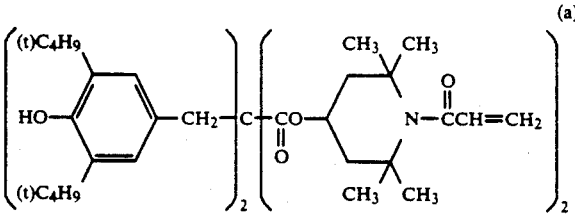
(b)
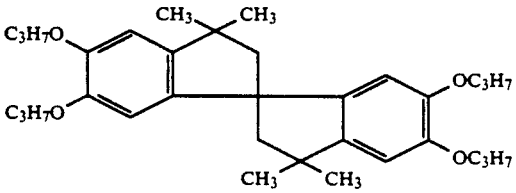
(c)
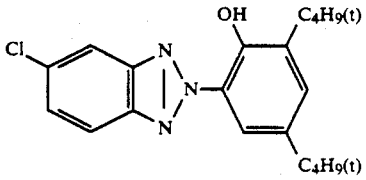
Ultraviolet absorber
(a)
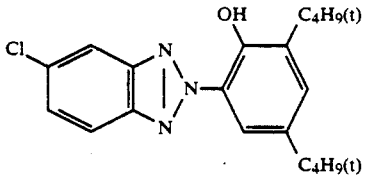
(b)
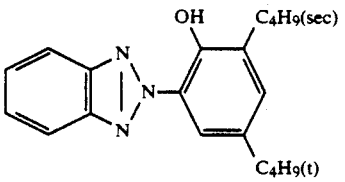
(c)
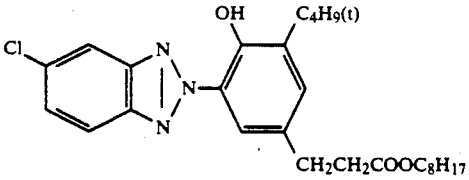
-continued
(d)
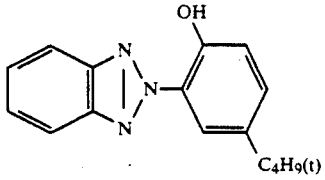
(e)
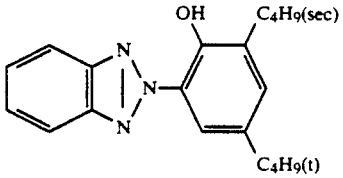
Color mixing inhibitor
(a)
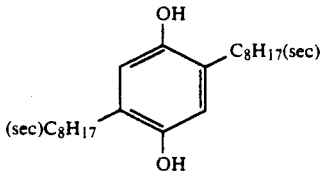
(b)
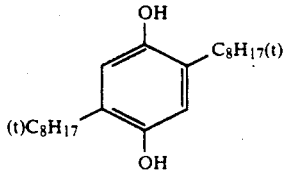
| Solvent | Chemical structure | Refractive index (25° C.) | Dielectic constant (25° C.) |
|---|---|---|---|
| (a) | 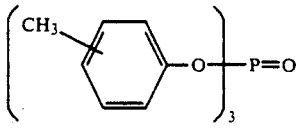 | 1.5552 | 7.33 |
| (b) | 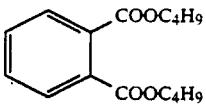 | 1.4926 | 6.45 |
| (c) | $(C_9H_{19}O)_3P{=}O$ | 1.4470 | 4.46 |
| (d) | $(C_8H_{17}O)_3P{=}O$ | 1.4419 | 4.80 |
The following dyes were used as irradiation inhibiting dyes of the respective emulsion layers.
Green sensitive emulsion layer
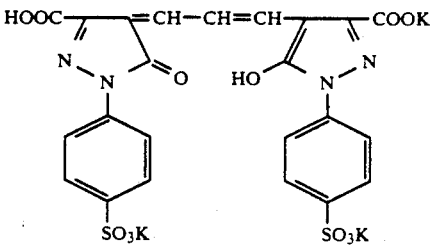
Red sensitive emulsion layer -continued

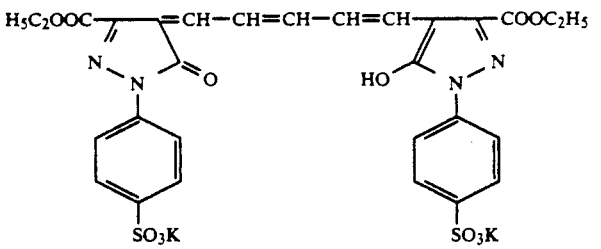

The following dyes were used as sensitizing dyes of the respective emulsion layers.

Blue sensitive emulsion layer

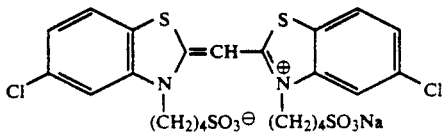

(Addition of $4.0 \times 10^{-4}$ moles per 1 mole of silver halide)

Green sensitive emulsion layer

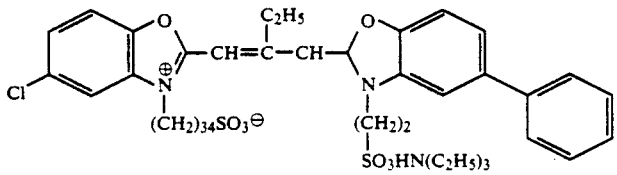

(Addition of $4.0 \times 10^{-4}$ moles per 1 mole of silver halide)

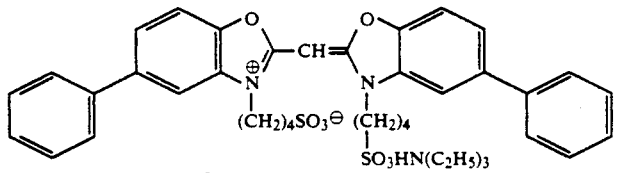

(Addition of $7.0 \times 10^{-5}$ moles per 1 mole of silver halide)

Red sensitive emulsion layer

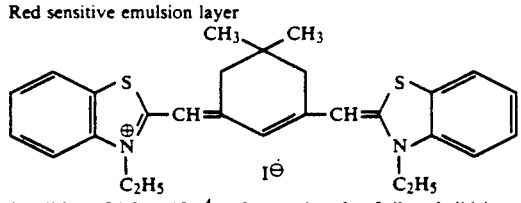

(Addition of $1.0 \times 10^{-4}$ moles per 1 mole of silver halide)

TABLE 1

| Layer | Main components | Amount used |
|---|---|---|
| The 7th layer | Gelatin | 1.33 g/m$^2$ |
| (Protective layer) | Acryl-modified polyvinyl alcohol copolymer (Modification degree 17%) | 0.17 g/m$^2$ |
| The 6th layer | Gelatin | 0.54 g/m$^2$ |
| (Ultraviolet absorbing layer) | UV absorber Mixture of (A), (b) and (c) in 1:5:3 (mole ratio) | $5.10 \times 10^{-4}$ mol/m$^2$ |
| The 5th layer | Silver chlorobromide emulsion (3) Silver bromide 70 mole % | 0.22 g/m$^2$ |
| (Red sensitive layer) | Gelatin | 0.90 g/m$^2$ |
| | Cyan coupler (II-14) | $7.05 \times 10^{-4}$ mol/m$^2$ |
| | Dye inage stabilizer Mixture of (c), (d) and (e) in 1:3:3 (mole ratio) | $5.20 \times 10^{-4}$ mol/m$^2$ |
| | Solvent (a) | 0.22 g/m$^2$ |
| The 4th layer | Gelatin | 1.60 g/m$^2$ |
| (Ultraviolet absorbing layer) | UV absorber Mixture of (a), (b) and (c) in 1:5:3 (mole ratio) | $1.70 \times 10^{-4}$ mol/m$^2$ |
| | Color mixing inhibitor (b) | $1.60 \times 10^{-4}$ mol/m$^2$ |
| | Solvent (b) | 0.24 g/m$^2$ |
| The 3rd layer | Silver chlorobromide emulsion (2) Silver bromide 75 mole % | 0.15 g/m$^2$ |
| (Green sensitive layer) | Gelatin | 1.56 g/m$^2$ |
| | Magenta coupler (a) | $3.38 \times 10^{-4}$ mol/m$^2$ |
| | Dye image stabilizer (b) | 0.19 g/m$^2$ |
| | Solvent Mixture of (a) and (d) in 1:1 (mole ratio) | 0.59 g/m$^2$ |
| The 2nd layer | Gelatin | 0.90 g/m$^2$ |

TABLE 1-continued

| Layer | Main components | Amount used |
|---|---|---|
| (Color mixing inhibiting layer) | Color mixing inhibitor (a) | $2.33 \times 10^{-4}$ mol/m$^2$ |
| The 1st layer | Silver chlorobromide emulsion (1) Silver bromide 80 mole % | 0.35 g/m$^2$ |
| (Blue sensitive layer) | Gelatin | 1.35 g/m$^2$ |
| | Yellow coupler (IV-35) | $6.91 \times 10^{-4}$ mol/m$^2$ |
| | Dye image stabilizer (a) | 0.13 g/m$^2$ |
| | Solvent Mixture of (b) and (c) in 1:1 (mole ratio) | 0.02 g/m$^2$ |
| Support | Polyethylene laminated paper (containing white pigments ($TiO_2$, etc.) and bluish dyes (ultramarine, etc.) in polyethylene on the first layer side) | |

The coating solutions of the 1st to 7th layers after their surface tension and viscosity balance were adjusted were coated on a paper support both faces of which had been laminated with polyethylene, to produce the sample 101.

The samples 102 to 116 were produced in the same manner as described above except that alternation shown in Table 2 was made. These samples were respectively subjected to an exposure to light where the exposure values of three colors of red, green and blue were respectively adjusted so that the densities in gray becomes 1.0 when these samples were observed under a fluorescent lamp for color evaluation (FL40SW-50-EDL manufactured by Toshiba Co., Ltd.) having a color temperature of 5000° K. Further, such exposed samples that were respectively colored to cyan, magenta, yellow, blue, green and red under the same exposure values as those described above by single exposures of respective red, green and blue and combined exposures of respective (red+green), (red+blue) and (green+blue) lights, were respectively produced and subjected to development process according to the following processing steps.

Measurement of the densities was carried out by FSD-103 (manufactured by Fuji Photo Film Co., Ltd.)

| Process step | Temperature | Time |
|---|---|---|
| Color development | 33° C. | 3.5 min. |
| Bleach-fixing | 33° C. | 1.5 min. |
| Water washing | 24–34° C. | 3 min. |
| Drying | 80° C. | 1 min. |

Composition of each processing solution is as follows.

| | |
|---|---|
| Developing solution formulation A | |
| Nitrilotriacetic acid 3Na | 2.0 g |
| Benzyl alcohol | 15 ml |
| Diethylene glycol | 10 ml |
| $Na_2SO_3$ | 2.0 g |
| KBr | 0.5 g |
| Hydroxylamine sulfate | 3.0 g |
| 4-Amino-3-methyl-N-ethyl-N-[β-(methansulfonamido)ethyl] -P-Phenylenediamine sulfate | 5.0 g |
| $Na_2CO_3$ monohydrate | 30.0 g |
| Total volume with addition of water | 1000 ml (pH 10.1) |
| Bleach-fixing solution formulation A | |
| Ammonium thiosulfate (54 wt %) | 150 ml |
| $Na_2SO_3$ | 15 g |
| $NH_4$[Fe(III)(EDTA)] | 55 g |
| EDTA 2Na | 4 g |
| Total volume with addition of water | 1000 ml (pH 6.9) |

The thus obtained samples which were respectively colored into gray, C, M, Y, B, G and R were respectively subjected to color measurement using M-307 type color analyzer manufactured by Hitachi Co., Ltd. With regard to the gray-colored sample, average color difference ΔE between the color measured under FL40SW-50-EDL of 5000° K and the respective colors measured under respective light sources of (a) tungsten light of 2854° K, (b) a cool white fluorescent lamp (FL40SW-S) of 4200° K, (c) a daylight fluorescent lamp (FL40S-S) of 6500° K and (d) a three wave length type fluorescent lamp (FL40S.EL) was calculated according to the CIE 1964 color difference formula. The smaller the color difference ΔE, the smaller the observation light source dependency.

Further, with regard to each sample having a color of R, G, B, C, M or Y, plotting was conducted about the CIE 1964 even color space based on the results of color measurement to evaluate color reproduction.

As for evaluation of color reproduction, it is necessary to consider the two points that how brilliant color is reproduced (saturation) and how faithfully color is reproduced (hue). The saturation of a color may be represented by the area of the reproduction region in CIE 1964 uniform color space, and it is necessary at that time to take importance of each color into account in order to synthetically evaluate changes of all colors. This method is disclosed in detail in Journal of Photographic Science 14, 87 (1966), and according to this method, distribution of importance on each color was conducted and the following A value was defined. It is noted that in proportion as this A value is larger, synthetic color reproduction region is broader.

$$A = 32C_R^* + 28C_G^* + 24C_B^* + 16C_Y^* + 10C_M^* + 12C_C^*$$

wherein $$C_i^* = \sqrt{U_i^{*2} + V_i^{*2}}$$

(i=R, G, B, C, M or Y)

Further, as for the faithfulness of hue, deviation from the sample 101 on magenta color is exhibited by representing by hue angle difference Δθ in the CIE 1964 uniform color space.

CIE 1964 color difference is disclosed in detail in JIS Z8729-1970.

The thus obtained ΔE, Δθ and A values are shown in Table 3 with the peak wave lengths $\lambda_{max}$ of dyes respectively singly colored into C, M and Y.

In a color print of the present invention, it is desired that A is 109 or more, Δθ is −5 to +5 and ΔE is 2.3 or less.

It is seen from the results of Table 3 that a combination in the present invention exhibits more excellent color reproduction than a combination where a 5-pyrazolone type magenta coupler which has hitherto been used is used, and that there is a $\lambda_{max}$ region satisfying a desirable hue and a desirable observation light source dependency at the same time in a region different from the optimum $\lambda_{max}$ in the usual combination.

TABLE 2

| Sample | Y Coupler | Y Solvent | M Coupler | M Solvent | C Coupler | C Solvent |
|---|---|---|---|---|---|---|
| 102 | (IV - 35) | (b) + (c) (1:1)* | (III - 33) | (a) | (II - 14) | (a) |
| 103 | " | " | (III - 33) | (a) + (d) (1:2) | " | " |
| 104 | " | " | (III - 33) | (d) | " | " |
| 105 | " | " | (III - 34) | (a) | " | " |
| 106 | " | " | (III - 35) | (a) | " | " |
| 107 | " | " | (III - 36) | (a) | " | " |
| 108 | " | " | (III - 1) | (a) | " | " |
| 109 | " | " | (III - 1) | (a) + (d) (1:2) | " | " |
| 110 | " | " | (III - 1) | (d) | " | " |
| 111 | " | " | (III - 37) | (a) + (d) (1:2) | " | " |
| 112 | " | " | (III - 37) | (a) | " | " |
| 113 | " | " | (III - 36) | (a) | (II - 14) + (I - 5) (1:1)** | " |
| 114 | (IV - 35) | (b) + (c) (1:1)* | (III - 1) | (a) | (II - 14) + (I - 5) (1:1)** | (a) |
| 115 | (IV - 35) | (b) + (c) (1:1)* | (III - 33) | (a) | (II - 14) + (I - 5) (1:1)** | (a) |
| 116 | (IV - 35) | (b) + (c) (1:1)* | (III - 35) | (a) | (II - 14) + (I - 5) (1:1)** | (a) |

TABLE 3

| Sample No. | $C_{\lambda max}$ | $M_{\lambda max}$ | $Y_{\lambda max}$ | A* | $\Delta\theta$** | $\Delta E$ | Note |
|---|---|---|---|---|---|---|---|
| 101 | 657 | 534 | 441 | 100.0 | 0 | 1.70 | Comparison |
| 102 | 657 | 550 | 441 | 108.8 | −6.4 | 2.67 | Comparison |
| 103 | 657 | 548 | 441 | 109.0 | −4.7 | 2.28 | Invention |
| 104 | 657 | 546 | 441 | 109.1 | −3.0 | 2.18 | Invention |
| 105 | 657 | 542 | 441 | 109.8 | +0.6 | 1.96 | Invention |
| 106 | 657 | 540 | 441 | 110.0 | +2.3 | 1.94 | Invention |
| 107 | 657 | 537 | 441 | 109.1 | +5.1 | 2.02 | Comparison |
| 108 | 657 | 533 | 441 | 108.3 | +8.4 | 2.13 | Comparison |
| 109 | 657 | 531 | 441 | 107.5 | 10.1 | 2.16 | Comparison |
| 110 | 657 | 528 | 441 | 106.6 | +12.7 | 2.16 | Comparison |
| 111 | 657 | 554 | 441 | 105.0 | −9.9 | 3.20 | Comparison |
| 112 | 657 | 556 | 441 | 105.0 | −11.6 | 3.45 | Comparison |
| 113 | 653 | 537 | 441 | 111.5 | +4.9 | 1.76 | Invention |
| 114 | 653 | 533 | 441 | 111.2 | +8.4 | 1.62 | Comparison |
| 115 | 653 | 550 | 441 | 109.0 | −6.4 | 2.78 | Comparison |
| 116 | 653 | 540 | 441 | 111.6 | +2.3 | 1.77 | Invention |

*A i a relative value taking the value of the sample 101 as 100.
**$\Delta\theta$ is represented by expressing change to B direction as (−) and change to Y direction as (t).

EXAMPLE 2

The emulsions used for the samples 101 to 116 produced in Example 1 were changed to the following silver chloride emulsions and further the sensitizing dyes and dyes were altered to produce the samples 201 to 216.

Methods for preparing the silver chloride emulsions used in this example 2 are exhibited below.

Liquid 8

$H_2O$ 1000 ml, NaCl 5.5 g, gelatin 32 g

Liquid 9

Sulfuric acid (IN) 20 ml

Liquid 10

The following compound (5%) 1.7 ml
$HOCH_2CH_2SCH_2CH_2SCH_2CH_2OH$

Liquid 11

NaCL 8.60 g, with addition of $H_2O$ 130 ml

Liquid 12

$AgNO_3$ 25 g, $NH_4NO_3$ (50%) 0.5 ml, with addition of $H_2O$ 130 ml

Liquid 13

NaCl 34.4 g, $K_2InCl_6$ (0.001%) 0.7 ml, with addition of $H_2O$ 285 ml

Liquid 14

$AgNO_3$ 100 g, $NH_4NO_3$ (50%) 2 ml, with addition of $H_2O$ 285 ml

Liquid 8 was heated to 72° C. and Liquid 9 and Liquid 10 were added thereto. Then, Liquid 11 and Liquid 12 were simultaneously added thereto over a period of 60 minutes 10 minutes thereafter, Liquid 13 and Liquid 14 were simultaneously added thereto over a period of 25 minutes 5 minutes after the addition, the temperature was lowered to carry out desalting. Water and dispersed gelatin were added thereto and the pH of the mixture was adjusted to 6.2, whereby a monodispersed cubic pure silver chloride emulsion having an average grain size of 0.8 μm and a variation coefficient of 0.1 was obtained Gold and sulfur sensitizations were made to this emulsion Gold was added thereto so as to make the concentration $1.0\times10^{-5}$ moles/mole Ag and the optimum chemical sensitization was given by sodium thiosulfate.

A silver halide emulsion of silver chloride content of 99.5 mole % for the green sensitive layer was prepared in the following manner.

Liquid 15

$H_2O$ 1000 ml, NaCl 5.5 g, gelatin 32 g

Liquid 16

Sulfuric acid (IN) 24 ml

Liquid 17

Compound of Liquid 10 (1%) 3 ml

Liquid 18

KBr 0.11 g, NaCl 10.95 g with addition of $H_2O$ 220 ml

Liquid 19

$AgNO_3$ 32 g, with addition of $H_2O$ 200 ml

Liquid 20

KBr 0.45 g, NaCl 43.81 g, $K_2IrCl_6$ (0.001%) 4.5 ml, with addition of water 600 ml Liquid 21

$AgNO_3$ 128 g, with addition of $H_2O$ 600 ml

Liquid 15 was heated to 40° C., and Liquid 16 and Liquid 17 were added. Then, Liquid 18 and Liquid 19 were simultaneously added over a period of 10 minutes. 10 minutes thereafter, Liquid 20 and Liquid 21 were simultaneously added over a period of 8 minutes. 5 minutes after the addition, the temperature was lowered to carry out desalting. Water and a dispersed gelatin were added thereto and the pH of the mixture was adjusted to 6.2, whereby a monodispersed cubic silver chlorobromide emulsion having an average grain size of 0.3 μm, a variation coefficient of 0.1 and a silver chloride ratio of 99.5 mole % was obtained. $4.1\times10^{-5}$ moles/mole Ag of chloroauric acid was added to the emulsion to carry out gold sensitization.

A monodispersed cubic silver chlorobromide emulsion for the red sensitive layer having an average grain size of 0.4 m, a variation coefficient of 0.1 and a silver chloride ratio of 99 mole % was obtained by the same manner as described above except of changing the compositions and temperatures of Liquid 18 and Liquid 20. This emulsion was subjected to gold and sulfur sensitizations. That is, $4.1\times10^{-5}$ moles/mole Ag of gold was added to the emulsion, and the optimum chemical sensitization was carried out using sodium thiosulfate.

Sensitizing dyes and irradiation inhibiting dyes used in this example are shown below.

A sensitizing dye or the blue sensitive layer

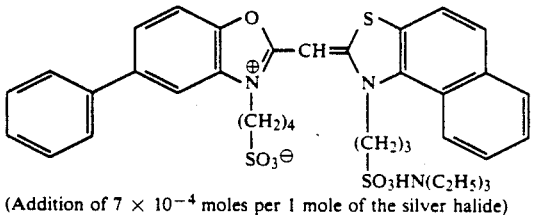

(Addition of $7\times10^{-4}$ moles per 1 mole of the silver halide)

A sensitizing dye for the green sensitive layer

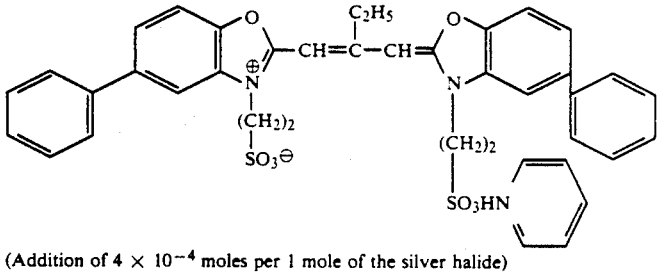

(Addition of $4\times10^{-4}$ moles per 1 mole of the silver halide)

A sensitizing dye for the red sensitive layer

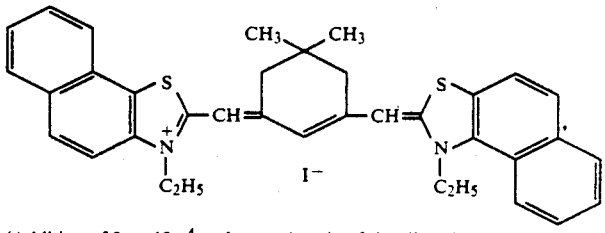

(Addition of $2\times10^{-4}$ moles per 1 mole of the silver halide)

An irradiation inhibiting dye for the green sensitive layer

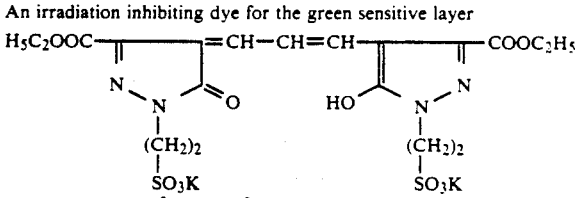

(Use of $2.1\times10^{-5}$ moles/m$^2$)

-continued

An irradiation inhibiting dye for the red sensitive layer

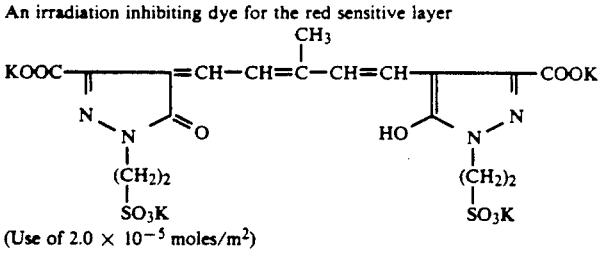

(Use of $2.0 \times 10^{-5}$ moles/m$^2$)

The thus obtained samples 201 to 216 were respectively exposed to light in the same manner as in Example 1, and then a process comprising the following steps was conducted.

Temperature and time adopted in each step and formulations are described below.

| Process step | Temperature | Time |
|---|---|---|
| Color developing (Formulation B) | 35° C. | 45 seconds |
| Bleach-fixing (Formulation B) | 35° C. | 45 seconds |
| Rinse | 28-35° C. | 1 minute and 30 seconds |

| Color developing solution formulation-B | |
|---|---|
| Water | 800 cc |
| Diethylenetriaminepentaacetic acid 5Na salt | 1.0 g |
| Sodium sulfite | 0.2 g |
| N,N-Diethylhydroxylamine | 4.2 g |
| Potassium bromide | 0.01 g |
| Sodium chloride | 1.5 g |
| Tirethanolamine | 8.0 g |
| N-Ethyl-N-(βmethanesulfonamidoethyl)-3-methyl-4-aminoaniline sulfate | 4.5 g |
| Potassium carbonate | 30.0 g |
| 4,4'-Diaminostilbene series fluorescent whitener (Whitex 4 manufactured by Sumitomo Chemical Co., Ltd.) | 2.0 g |
| Total amount with addition of water | 1000 cc (pH 10.1) |

| Bleach-fixing solution formulation-B | |
|---|---|
| Water | 700 cc |
| Ammonium thiosulfate (54 wt %) | 150 cc |
| Sodium sulfite | 15 g |
| $NH_4$[Fe(III)(EDTA)] | 55 g |
| EDTA 2Na (dihydrate) | 4 g |
| Glacial acetic acid | 8.61 g |
| Total amount with addition of water | 1000 cc (pH 5.4) |

| Rinse solution formulation | |
|---|---|
| EDTA 2Na (dihydrate) | 0.4 g |
| Total amount with addition of water | 1000 cc (pH 4.7) |

Samples which were respectively developed and colored into gray, C, M, Y, R, G and B were respectively subjected to colorimetry according to the method of Example 1 to obtain the results shown in Table 4.

Since benzyl alcohol was not contained in the color developing solution, saturation was remarkably enhanced in the combination of the present invention compared with the combination using the 5-pyrazolone type magenta coupler in Example 1. Similar results as in Example 1 were obtained in other points than saturation.

TABLE 4

| Sample No. | $C_{\lambda max}$ | $M_{\lambda max}$ | $Y_{\lambda max}$ | A* | Δθ** | ΔE | Note |
|---|---|---|---|---|---|---|---|
| 201 | 656 | 534 | 441 | 100.0 | 0 | 1.74 | Comparison |
| 202 | 656 | 550 | 441 | 109.3 | −6.4 | 2.68 | Comparison |
| 203 | 656 | 548 | 441 | 109.5 | −4.7 | 2.28 | Invention |
| 204 | 656 | 546 | 441 | 109.6 | −3.0 | 2.19 | Invention |
| 205 | 656 | 542 | 441 | 110.2 | +0.6 | 1.98 | Invention |
| 206 | 656 | 540 | 441 | 110.6 | +2.3 | 1.95 | Invention |
| 207 | 656 | 537 | 441 | 109.5 | +4.9 | 2.03 | Comparison |
| 208 | 656 | 533 | 441 | 108.8 | +8.4 | 2.15 | Comparison |
| 209 | 656 | 531 | 441 | 107.8 | +10.1 | 2.17 | Comparison |
| 210 | 656 | 528 | 441 | 107.0 | +12.7 | 2.19 | Comparison |
| 211 | 656 | 554 | 441 | 105.3 | −9.9 | 3.22 | Comparison |
| 212 | 656 | 556 | 441 | 105.3 | −11.6 | 3.49 | Comparison |
| 213 | 652 | 537 | 441 | 112.0 | +4.9 | 1.78 | Invention |
| 214 | 652 | 533 | 441 | 111.8 | +8.4 | 1.64 | Comparison |
| 215 | 652 | 550 | 441 | 110.0 | −6.4 | 2.79 | Comparison |
| 216 | 652 | 540 | 441 | 112.2 | +2.3 | 1.79 | Invention |

*A is a relative value taking the value of the sample 201 as 100.

As is seen from the foregoing, multi-layered silver halide photosensitive materials of the present invention gave epochally improved color reproduction, and marring of color balance of the images was small, even when the images were observed under different light sources.

What we claim is:

1. A process for producing a color print which comprises a steps of imagewise exposing to light a silver halide photosensitive material and then subjecting the exposed silver halide material to color development with a color developer containing benzyl alcohol in an amount less than or equal to 5 ml/l, the silver halide photosensitive material containing a reflecting support having provided thereon a red sensitive silver chlorobromide emulsion layer containing silver bromide in an amount of 10 mol % or less and at least one of the couplers represented by the following general formula (I) and the couplers represented by the following general formula (II), a green sensitive silver chlorobromide emulsion layer containing silver bromide in an amount of 10 mol % or less and at least one of the couplers represented by the following general formula (III), and a blue sensitive silver chlorobromide emulsion layer containing silver bromide in an amount of 10 mol % or less at least one of the couplers represented by the following general formula (IV); these couplers respectively existing in droplets of a high boiling organic solvent and/or water insoluble high molecular compound each having a dielectric constant of 2 to 20° at 25° C. and a refractive index of 1.3 to 1.7 at 25° C., said couplers being dispersed in the respective emulsion layers, and the spectral absorption peak wave lengths of the respective colored dyes as formed by coupling reaction of the respective couplers with the oxidized form of a paraphenylenediamine developing agent lying in the range represented by the following formula (I):

$$\tfrac{1}{2}(\lambda y+\lambda c) \geqq \tfrac{1}{2}(\lambda y+\lambda c)-10 \qquad \text{(I)}$$

wherein

λc = Spectral absorption peak wave length (nm) of the colored cyan dye

λm = Spectral absorption peak wave length (nm) of the colored magenta dye

λy = Spectral absorption peak wave length (nm) of the colored yellow dye

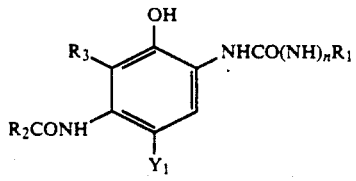

(I)

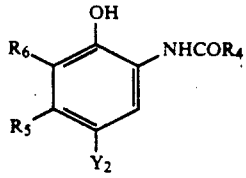

(II)

-continued

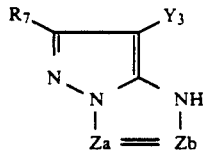

(III)

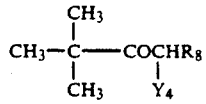

(IV)

wherein $R_1$, $R_2$ and $R_4$ independently represent substituted or unsubstituted aliphatic, aromatic or heterocyclic groups; $R_3$, $R_5$ and $R_6$ independently represent hydrogen atoms, halogen atoms, substituted or unsubstituted, aliphatic, aromatic groups or acylamino groups, and $R_3$ may represent with $R_2$ a nonmetal atomic group which forms a nitrogen-containing 5- or 6-membered ring; $R_7$ represents a hydrogen atom or a substituent; $R_8$ represents a substituted or unsubstituted N-phenylcarbamoyl group; $Z_a$ and $Z_b$ independently represent methines, substituted methines, =N= or —NH—; n is 0 or 1; and $Y_1$, $Y_2$, $Y_3$ and $Y_4$ independently represent hydrogen atoms or groups eliminable at the coupling reaction with the oxidized form of the developing agent.

2. A process of claim 1, wherein the couplers represented by the general formula (I) or (II), the general formula (III), and the general formula (IV) are respectively contained in the respective silver halide emulsion layers in an amount of 0.1 to 1.0 mole per 1 mole of silver halide.

3. A process of claim 1, wherein when the high boiling organic solvent and/or the water insoluble high molecular compound are dispersed in each silver halide emulsion layer, a low boiling organic solvent having a boiling point of 30° to 150° C. is used as an auxiliary solvent.

4. A process of claim 1, wherein at least one of the silver halide emulsions is monodispersed emulsion having a coefficient of variation of 0.15 or less.

5. A process of claim 4, wherein at least one of the silver halide emulsions is monodispersed emulsion having a coefficient of variation of 0.10 or less.

6. A process of claim 1, wherein silver halide grains contained in at least one of the silver halide emulsion layers are mainly regular crystals of cubic or tetradecahedral form.

7. A process of claim 1, wherein the color development is carried out in a color developer not containing benzylalcohol.

* * * * *